US010433382B2

(12) United States Patent
Kottritsch et al.

(10) Patent No.: US 10,433,382 B2
(45) Date of Patent: Oct. 1, 2019

(54) LOW FLICKER AC DRIVEN LED LIGHTING SYSTEM, DRIVE METHOD AND APPARATUS

(71) Applicant: LYNK LABS, INC., Elgin, IL (US)

(72) Inventors: Robert Kottritsch, Shefford Bedfordshire (GB); Mike Miskin, Sleepy Hollow, IL (US); Qinheng Wang, Shanghai (CN)

(73) Assignee: LYNK LABS, INC., Elgin, IL (US)

( * ) Notice: Subject to any disclaimer, the term of this patent is extended or adjusted under 35 U.S.C. 154(b) by 0 days.

(21) Appl. No.: 15/564,830

(22) PCT Filed: Apr. 11, 2016

(86) PCT No.: PCT/US2016/026992
§ 371 (c)(1),
(2) Date: Oct. 6, 2017

(87) PCT Pub. No.: WO2016/164928
PCT Pub. Date: Oct. 13, 2016

(65) Prior Publication Data

US 2018/0110101 A1 Apr. 19, 2018

Related U.S. Application Data

(60) Provisional application No. 62/388,437, filed on Jan. 29, 2016, provisional application No. 62/178,415, filed on Apr. 9, 2015.

(51) Int. Cl.
*H05B 33/08* (2006.01)

(52) U.S. Cl.
CPC ..... *H05B 33/0824* (2013.01); *H05B 33/0845* (2013.01)

(58) Field of Classification Search
CPC ..... H05B 33/0824; H05B 33/083; H05B 33/0815; H05B 33/0821; H05B 33/0827;
(Continued)

(56) References Cited

U.S. PATENT DOCUMENTS 6,965,205 B2 * 11/2005 Piepgras ..... H05B 33/0857 315/292
7,863,831 B2 * 1/2011 Vos ..... H05B 33/0827 315/155

(Continued)

FOREIGN PATENT DOCUMENTS

WO WO 2014/189298 A1 11/2014

OTHER PUBLICATIONS

International Search Report and Written Opinion for International Application No. PCT/US2016/026992 dated Aug. 25, 2016, 14 pages.

(Continued)

*Primary Examiner* — Haissa Philogene
(74) *Attorney, Agent, or Firm* — Haynes and Boone, LLP

(57) ABSTRACT

An LED lighting device having a first LED circuit having at least one LED and at least a first switch connected in series with the first LED circuit and a second LED circuit having at least one LED and at least a second switch connected in series with the second LED circuit. The device includes a third switch configured to connect the first LED circuit in series with the second LED circuit and a controller for dynamically controlling the first switch, the second switch and the third switch to connect the first LED circuit and the second LED circuit in series or parallel configurations in response to an input to the controller.

31 Claims, 11 Drawing Sheets

(58) Field of Classification Search
CPC ..... H05B 33/0845; H05B 33/0857; H05B 33/0818; H05B 37/02; H02M 7/539; H02M 7/5395; Y02B 20/346
See application file for complete search history.

(56) References Cited

U.S. PATENT DOCUMENTS

| | | | | |
|---|---|---|---|---|
| 7,902,771 | B2 | 3/2011 | Shteynberg et al. | |
| 8,198,819 | B2 * | 6/2012 | Lenk | H05B 33/0845 315/185 R |
| 8,519,635 | B2 * | 8/2013 | Lin | H05B 33/083 315/122 |
| 8,638,045 | B2 * | 1/2014 | Kunst | H05B 33/0815 315/291 |
| 8,680,782 | B2 | 3/2014 | Sakuragi et al. | |
| 8,760,064 | B1 | 6/2014 | Yoon et al. | |
| 9,035,575 | B2 * | 5/2015 | Lee | H05B 33/0824 315/315 |
| 10,004,118 | B1 * | 6/2018 | Mi | H05B 33/083 |
| 10,034,346 | B2 * | 7/2018 | Qiu | H05B 33/0827 |
| 10,091,851 | B1 * | 10/2018 | Lang | H05B 33/0845 |
| 2011/0095704 | A1 | 4/2011 | Moussakov et al. | |
| 2011/0227484 | A1 | 9/2011 | Huynh | |
| 2012/0133289 | A1 | 5/2012 | Hum et al. | |
| 2012/0161651 | A1 | 6/2012 | Hon et al. | |
| 2013/0038222 | A1 | 2/2013 | Yeh et al. | |
| 2013/0051001 | A1 | 2/2013 | Miskin | |
| 2013/0307424 | A1 | 11/2013 | Gray et al. | |

OTHER PUBLICATIONS

Invitation pursuant to Rule 62a(1) EPC; issued by the European Patent Office for Application No. 16777509.7-1204; Nov. 14, 2018; 3 pgs.

Communication pursuant to Rules 70(c) and 70a(2) EPC; issued by the European Patent Office for Application No. 16777509.7; dated Apr. 2, 2019; 9 pgs.

* cited by examiner

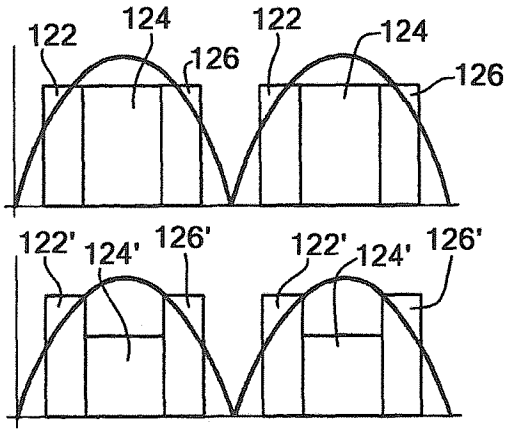
FIG. 4A
FIG. 4B
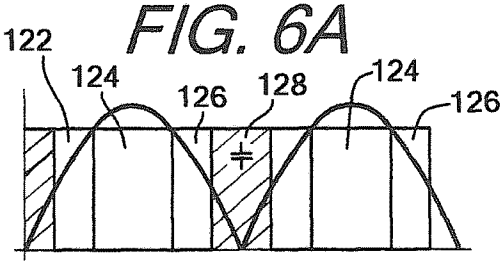
FIG. 6A
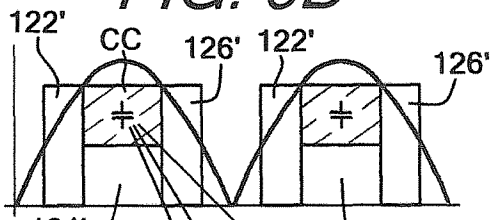
FIG. 6B
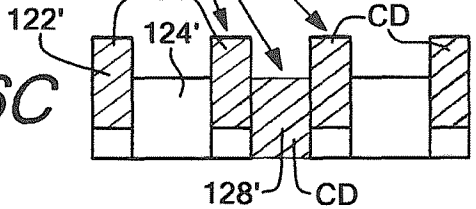
FIG. 6C
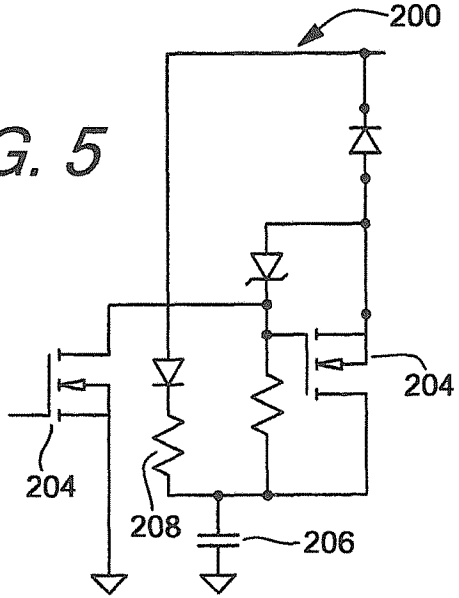
FIG. 5

CAPACITOR VOLTAGE
V
a
b
c
500'
506'
508'
510'
502'
512'

LOW FLICKER AC DRIVEN LED LIGHTING SYSTEM, DRIVE METHOD AND APPARATUS

RELATED APPLICATIONS

The present application is a national phase of International Patent Application No. PCT/US2016/026992, filed Apr. 11, 2016, which claims priority to U.S. Provisional Patent Application No. 62/388,437 filed Jan. 29, 2016 and U.S. Provisional Patent Application No. 62/178,415 filed Apr. 9, 2015 the contents of all of which are expressly incorporated herein by reference.

TECHNICAL FIELD

The present invention generally relates to AC light emitting diode ("LED") apparatuses, systems and drive methods, and more specifically to AC LED apparatuses, systems and drive methods having low or nearly no flicker and emit a substantially constant amount of light while having an improved power factor and minimal total harmonic distortion.

FEDERALLY SPONSORED RESEARCH OR DEVELOPMENT

None.

BACKGROUND OF THE INVENTION

It has become more common to power LEDs and LED circuits using AC voltage, and in particular AC line voltage. The LEDs or LED circuits are typically integrated into a lighting system, device or lamp, and may be configured in a manner in which LEDs alternate turning on and off with the current. For example LEDs may be configured in an anti-parallel relationship or may be configured in a bridge or unbalanced bridge configuration as shown in Lynk Labs U.S. Pat. Nos. 7,489,086 and 8,179,055.

Alternatively, and more typically, LEDs and LED circuits driven with an input of AC power from an AC power source are provided with voltage by a full or half wave rectifier placed between the LEDs, or LED circuits, and the AC power source as seen for example in Lynk Labs U.S. Patent Publication No. 2012/0293083. FIG. 1 generally shows an example of a known linear step drive topology. FIG. 1, for example, shows a series string of LEDs forming a single LED circuit, with groups of LEDs in the circuit being connected in parallel with distinct switches. Series string or LED string should be understood in the art to mean two or more LEDs connected in series with each other, i.e. a series circuit of multiple LEDs or in some cases LED circuits. In such configurations, as the provided voltage increases, the switches will begin to open causing more LEDs to turn on to match the voltage—for example, in FIG. 1 once the provided forward voltage is enough for the LEDs in the first segment to turn on the first switch in parallel with the first segment will open causing current to flow through those LEDs causing light emission, once the forward voltage is enough to turn on the first and second segment of LEDs, the second switch will open causing current to flow through the second segment of LEDs along with the first segment of LEDs thereby following and closer matching the input voltage level.

Rather than use the configuration discussed above, in order to attempt to address flicker and protect the LEDs, some systems and devices operate in a similar manner to a linear step drive. Rather than have a single series string with multiple groups divided by parallel bypass switches, these system and devices may have multiple series string of LEDs each having different numbers of LEDs with the series strings being connected in parallel. Once the forward operating voltage is enough to drive the first series string having a set number of LEDs, the first series string will be switched on and provided with voltage. Once the forward operating voltage is large enough to drive the second series string, the first series string may be switched off and the second series string switched on alone or along with the first series string, and so on.

Linear step drive topologies like that shown in FIG. 1 or similar configurations have been shown to have a satisfactory power factor and very low overall total harmonic distortion, however they, like directly driven AC LED circuits, have two major problems that must be addressed—they do not completely solve the flicker issue, and they create a near constant changing level of light flux emitted by the device as different numbers of LEDs turn on and off.

Many of the known prior art systems fail to reduce or even eliminate flicker in response to an AC voltage source, and/or for the period where the AC voltage is not high enough to drive any LEDs or LED circuits in the drive system, i.e. at the beginning and end of each half cycle of input AC or rectified AC voltage. As the voltage alternates, whether it is provided directly to an LED circuit or rectified first, as the voltage approaches and crosses zero, there will reach a point where the provided voltage is less than the forward operating voltage of any LEDs or LED circuits in the device. When the input voltage drops below the lowest forward operating voltage required to drive any LEDs or LED circuits in the device or system, all the LEDs will effectively be turned off, creating a brief moment where the system or device emits no light. In this sense flicker is created as the system or device stops emitting light for a brief moment, causing the light to turn off before the provided AC voltage is back above the lowest operable forward operating voltage in the device.

Though flicker in LEDs may be imperceptible to individuals above the threshold above a certain frequency, like for example approximately 70 Hz, and LEDs will typically operate at approximately between 100 Hz or 120 Hz in countries around the world, studies have shown that animals and some humans may be effected at this range, and stroboscopic effects may be visible when moving objects are illuminated by a system or device at a second, higher frequency, like for example, 120 Hz or higher. In order to prevent problems associated with flicker, it has been found that a modulation rate of over a certain frequency, like for example 200 Hz or higher is required. The present systems and devices known in the art only provide this using electronic transformers or the like.

In order to address the issue associated with flicker, there have been apparatuses developed which attempt to provide some level of power to LEDs during the periods at the beginning and end of each half cycle. For example, systems have been developed which include a switch controlled capacitor or multiple capacitors which may be used to store power during a peak current of each half cycle of an input voltage, and discharge that power to an entire or a portion of a linear step drive circuit at the beginning, end and in between half cycles. While this configuration may help alleviate some of the issues associated with flicker, unless very large levels of capacitance are provided, the power stored is usually less than that required to maintain the level of voltage and current necessary to fill the entire gap from the end of one half cycle through the beginning of the next half cycle, particularly since the proposed apparatuses to date do not provide any control for when and/or how the discharge of the capacitor will occur in response to the AC input. Control is only provided to control the charging of the capacitor.

Furthermore, the combination of a switch controlled capacitor and a linear step circuit do nothing to alleviate the issues related to the near constant changing level of light flux emitting from the apparatus as it is still a linear step drive.

In linear step drives or similar circuits, as the voltage increases, the number of LEDs turned on in series likewise increases to increase the forward operating voltage to match the input voltage provided by the AC voltage source. Conversely, as the voltage decreases in magnitude and approaches zero at the end of the half cycle, the number of LEDs turned on in series will decrease to match the forward operating voltage to the decreasing input voltage. As the voltage builds towards it peak magnitude, the amount of light provided by the lighting systems or device will increase as more LEDs in series and/or LED circuits are turned on in order to increase the forward operating voltage and match the input voltage. Once the voltage reaches its peak magnitude and begins to decrease, fewer LEDs and/or LED circuits will be turned on in order to insure that the forward operating voltage is not greater than the provided input voltage and insure that at least some of the LEDs are on and emitting light. As LEDs and/or LED circuits are turned on and off in such configurations, the amount of light emitted by the system or device increases and decreases, causing a near constant change in the light flux of the entire device. The total power dissipation likewise is in constant flux, reflecting the change in flux as LEDs are turned on and off in different numbers.

The present invention is provided to solve these and other issues.

SUMMARY OF THE INVENTION

The present invention is directed to an LED lighting device which has a substantially constant flux, substantially without flicker, while maintaining a high power factor and low total harmonic distortion. The LED lighting devices may be integrated into LED lighting systems. Alternatively, though the term device is used herein, the "devices" may instead be designed as systems, apparatuses, elements, fixtures, lamps or the like.

In order to provide substantially constant flux, it is desirable that any LEDs or LED circuits which are turned on during each portion of an input voltage waveform in the present invention, dissipate a substantially constant total amount of power, with the current following through each individual LED remaining substantially constant, as the circuit or circuits are controlled and switched. In order to accomplish this, many of the embodiments shown herein are configured so that during a first portion of an input AC voltage or rectified AC voltage half cycle, when voltage is at its lowest, a higher total current is drawn through the LEDs, by for example placing multiple LEDs or LED circuits in parallel with each other. As the input voltage increases and reaches a second level where some but not all the LEDs or LED circuits can be driven in series, in some, but not all embodiments, the LEDs may be re-configured in a series parallel relationship. This reduces the total current drawn by the circuit while maintaining a relatively constant current through each LED. However, as a result of the voltage drop across the circuit increasing while the total current draw decreases, the total power dissipation of all circuits remains constant. As the input voltage increases further and eventually reaches a point where the forward operating voltage of all the LEDs or LED circuits combined within the device, the LEDs or LED circuits are re-configured into a series relationship, further causing the amount of total current drawn by all the LED circuits to drop, the total current drop again being offset by the increase in voltage drop across the series string of LEDs. The result of constantly changing the configuration is a substantially constant total power dissipation through the LEDs and LED circuits in the device by using changing circuit configurations to manage increased voltage drops and reduce the total current drawn by all LED circuits as the voltage increases.

It should be understood that substantially constant flux as used herein refers to a substantially constant light flux relative to the input voltage, regardless of voltage level. So, for example, if any of the devices herein are connected to a dimmer switch such as phase cut, 0-10V dimmer or other type of dimmer control which is capable of dimming the output of the LED lighting device by reducing the input voltage or other input signal to the controller, the controller within the device may appropriately adjust its output in response to dimmer input signal and control any switches and capacitance circuits within the device accordingly. For example, if a dimmer switch is set to provide one-half the normal voltage and/or signal output, thereby reducing the light flux from the device by one-half as well, the controller, any capacitance circuits including any circuitry to control the discharging of the capacitors within the capacitance circuits, will control the device to substantially constantly maintain that one-half light flux output. If the switch is then turned to full voltage and/or full on output level, the switch will again adjust its input response and operate the device to maintain substantially constant full light flux. The controller will control the switches and capacitance circuits herein to insure that a substantially constant light flux relative to the voltage input and/or other input signals is maintained even if that level is less than full light flux for the device.

It should also be appreciated that the term "substantially constant" when used relative to light flux or power dissipation allows for some fluctuation as the voltage increases between re-configuration of any LEDs or LED circuits in the device. For example, when two LED circuits are connected in parallel, as the input voltage increases, but before it reaches a level where the two LED circuits may be forward driven in series, the resulting increase in voltage may result in a very slight increase in power dissipation or light flux. Similarly, when the voltage is falling during the second half of the half cycle, when the two LED circuits are connected in series, for example, the light flux and total power dissipation may realize a very slight drop before the two LED circuits are re-configured in a parallel configuration. Once the switches occur, the light flux and total power dissipation will remain substantially constant with the previous configuration. Though there may be slight fluctuations in light flux and total power dissipation between the switching of the configurations of the circuits, the effect of the devices in the present application and the re-configuring of the LED circuits as the input voltage cycle and half cycle rises and falls, provide a "substantially" constant light flux and total power dissipation as these fluctuations are very small, and nearly non-existent compared the fluctuations realized in prior art devices where entire strings of LEDs are turned on and off and as the input voltage, and consequently the total power dissipation of the prior art devices, rises and falls.

According to one embodiment of the invention, an LED lighting device is provided. The LED lighting device includes a first LED circuit having at least one LED with at least a first switch being connected in series with the first LED circuit, and a second LED circuit being in parallel with the first LED circuit, the second circuit having at least one LED with at least a second switch connected in series with the second LED circuit. The device includes a third switch configured to connect the first LED circuit in series with the second LED circuit. In order to control the switches, a controller for dynamically controlling the first switch and the second switch to connect the first LED circuit and the second LED circuit in parallel, and to control the third switch to connect the first LED circuit and the second LED circuit in series is provided. The controller dynamically changes and/or controls the switches in order to change the connection of the LED circuits in response to an input to the controller.

In all embodiments discussed herein, the input to the controller may be, for example, a voltage or a current which may be AC or rectified AC, or may be a signal from a driver or other known circuit element used in conjunction with the device. The input may be something derived or generated by the controller as well, like for example a timer or the like generated based upon an input voltage or current phase, for example. Regardless of what the ultimate input to the controller is, in each embodiment discussed herein, the input to the controller should correspond to the input voltage provided to the LED circuit(s). The controller should control the switches and modify the circuit configurations in response to the input to the controller, and therefore the input voltage to the circuits, rising or falling above or below thresholds which will drive certain circuit configurations, like for example parallel, series parallel or series configurations of the LED circuits in the device. For example, as the input voltage reaches the lowest forward operating voltage of a circuit configuration in one of the devices of the invention, the input to the controller should likewise reach a first value or threshold so that the controller causes the appropriate switches to close so that the circuits are configured in the lowest forward operating voltage configuration. Once the input voltage reaches a second forward operating voltage for a combination of LED circuits in the device, the input to the controller should likewise reach a second value or threshold so that the controller can dynamically control the switches to configure the circuit in a manner which operates at the second forward operating voltage and so on.

The LED lighting device may also include a bridge electrically connected in series with the first LED circuit and the second LED circuit.

In order to prevent flicker and provide a substantially constant state of light flux from the lighting device, the lighting device may include at least one capacitance circuit for storing and providing charge to at least one of the first and second LED circuits. The at least one capacitance circuit may include a first capacitor switch connected to the bridge rectifier and the controller, and a second capacitor switch connected to at least one of the first LED circuit and the second LED circuit, and the controller. A capacitor is connected to the switches. Like the switches associated with the first and second LED circuits, the controller dynamically controls the capacitor switches based upon the input to the controller. The controller may dynamically close the first capacitor switch to charge the capacitor during at least a first portion the input to the controller which corresponds to a portion of the input voltage during its half cycle, and may dynamically close the second capacitor switch to discharge the capacitor to at least one of the first or second LED circuits during at least a second portion of the input to the controller, corresponding to a second portion of the input voltage half cycle.

In order to protect and control the charging of the capacitor, the capacitance circuit may include a current controlling device connected in series with the capacitor. The current controlling device may be a passive element, like for example a resistor or inductor, or may be an active device like for example a current limiting diode, a constant current regulator, or a transistor or switch which permits voltage and current to reach the capacitor at desired periods. When a transistor is used, the transistor may be connected to the controller to control the times at which the capacitor is charged.

At least one additional capacitance circuit, i.e. at least a second capacitance circuit, substantially identical to the first may be provided in the LED lighting device as well. The second capacitance circuit may include some or all of the elements of the first capacitance circuit and will at least include a third capacitor switch (the first capacitor switch in the second capacitance circuit) and a fourth capacitor switch (the second capacitor switch in the second capacitance circuit) connected to a second capacitor. The first and third capacitor switches may be controlled in a substantially similar manner—both may be closed by the controller to charge its respective capacitor during a first portion of the input to the controller and corresponding first portion of the half cycle of an input voltage. However, when the first and third capacitor switches are turned on may be staggered in order to avoid a disruption in total harmonic distortion and achieve maximum benefit. For example, the first capacitor switch may turn on during a first part of the first portion of the input to the controller, while the second capacitor switch turns on during a second part of the first portion of the input to the controller. This insures that the current drawn by the capacitance circuits is staggered to some degree so that the total current drawn by the device is not distorted by both capacitance circuits drawing current at the same time. The second and fourth capacitor switches may act in substantially the same manner as each other, however, the second and fourth capacitor switches may be controlled independent of each other. Controlling the switches independent of each other helps to further fill the "valley" which exists at the end of and between each half voltage cycle and avoid a change in light flux from the device and help eliminate any flicker. For example, the first capacitance circuit may be controlled to discharge at the end of a first half cycle of a rectified voltage waveform, both capacitance circuits controlled to discharge during the period at the very end of the first half cycle, between half cycles and at the very beginning of the second half cycle, while only the second capacitance circuit is controlled to discharge at the beginning of the second half cycle. In order to match voltages provided by one, two or more capacitance circuits, the controller may dynamically switch the connection of the first and second LED circuits. For example when once capacitance circuit is discharging the controller may close the switches required to make the first and second LED circuits in parallel, while when two capacitance circuits are discharging at the same time, the controller may open and close switches to place the circuits in a series, or when more than two LED circuits are used series-parallel, configuration.

Regardless of whether zero, one, two or more capacitance circuits are used in the device, each LED circuit may have an additional switch placed in series with it so that two switches are connected in series with each LED circuit. For example a fourth switch may be connected in series with the first LED circuit and arranged with the first switch so that one switch is connected in series with the input of the first LED circuit and one switch is connected in series with the output of the first LED circuit. Similarly, a fifth switch may be connected in series with the second LED circuit and arranged with the second switch so that one switch is connected in series with the input of the second LED circuit and one switch is connected in series with the output of the second LED circuit.

Connecting and configuring the LED circuits to have switches at the input and output of each circuit allows for additional configurations when additional LED circuits are added to the device, like for example a third and fourth LED circuit, both placed in "parallel" with the first and second LED circuits.

For example, the LED lighting device may include a third LED circuit having at least one LED and sixth and seventh switches connected in series with the third LED circuit and arranged so one switch is connected in series with the input of the third LED circuit and one switch is connected in series with the output of the third LED circuit. The LED lighting device may also include a fourth LED circuit having at least one LED and eighth and ninth switches connected in series with the fourth LED circuit and arranged so one switch is connected in series with the input of the fourth LED circuit and one switch is connected in series with the output of the fourth LED circuit. In order to provide further control and further configurations, switches may be used to bridge each adjacent "parallel" LED circuit. For example, a tenth switch may be connected to the output of the second LED circuit and the input of the third LED circuit while an eleventh switch may be connected to the output of the third LED circuit and the input of the fourth LED circuit. When multiple LED circuits and switches are used in this manner, each switch is controlled by the controller. The controller may dynamically control the switches to connect each of the first, second, third, and forth LED circuits in parallel in a first configuration. The controller may also open and close the network of switches to connect the first LED circuit in series with the second LED circuit forming a first series circuit, and the third LED circuit connected in series with the fourth LED circuit forming a second series circuit, with the controller connecting the first series circuit in parallel with the second series circuit in a second configuration. The controller may also control the network of switches to connect each of the first, second, third, and fourth LED circuits in series in a third configuration.

When two or three or four LED circuits are used, each circuit may include at least one LED, like for example at least two LEDs connected in series, and the LEDs may be similar, or emit light of a different wavelength than the remaining circuits. For example, the LED circuit(s) turned on at the lowest level of input voltage and/or signal to the controller from a dimmer or other source may provide an output wavelength of light that is warmer in Kelvin than that of the additional LED circuits that are turned on with a higher voltage or signal input to the controller. The number of LEDs in each circuit may be the same, for example each circuit may have one, two, four or more LEDs, or the number of LEDs may vary from LED circuit to circuit as well.

In order to further control the flux output of the lighting device and also insure that any capacitance circuits are discharged over the entire required period at the beginning and end of each half cycle, and adjust to phase cut input voltages resulting from the use of a dimmer switch for example, the LED lighting device may also include dimmer control which regulates the voltage and current provided to each LED circuit. The dimmer control may be dynamically controlled by the controller, or implemented by the controller, and may be used to reduce or modify the voltage and current provided to the LED circuits during at least one portion of the phase of an input AC voltage when less than the full input voltage is being provided to the LED circuits. For example the dimmer control may reduce the current drawn from the capacitor(s) and supplied to the LED circuit(s) when a voltage half cycle is at the beginning or end. By reducing the current drawn from the capacitors, the discharge is extended to cover the longer discharge requirement due to a phase cut voltage, and the light output of the device is maintained substantially constant as the current to each LED is reduced to match what the voltage input provides each LED throughout the voltage cycle.

According to one embodiment of the invention, rather than using parallel LED circuits and a network of switches to create different circuit configurations, each LED circuit provided in the LED lighting device may be pre-configured in desired LED circuit configurations, and a minimal number of switches may be used to connect the different LED configurations to the bridge rectifier. For example, the LED lighting device may include a bridge rectifier feeding a first LED circuit, a second LED circuit and a third LED circuit. The first LED circuit may have at least one LED and be connected to the bridge rectifier using at least a first switch. The second LED circuit may have at least two series strings of LEDs each string having at least two LEDs connected in series, the series strings being connected in parallel, i.e. a series parallel configuration, with the entire second LED circuit may be connected to the bridge rectifier using a second switch. The third LED circuit may have at least one LED directly connected to the bridge rectifier or connected to the bridge rectifier using a third switch. The device may further include a controller for dynamically controlling the switches to connect either the first LED circuit, the second LED circuit, or the third LED circuit to the bridge rectifier in response to an input to the controller which corresponds to an input voltage provided to the first, second and third LED circuits. It is contemplated that each individual LED circuit may have its own dedicated bridge rectifier and the bridge rectifier may then be switched and/or connected to a voltage and/or current source.

An LED lighting device having pre-configured first, second, third and any subsequent circuits may include at least one capacitance circuit for storing charge and providing charge to at least one of the first, second, third or any subsequent LED circuits. The capacitance circuit may include a first capacitor switch connected to a bridge rectifier and the controller and a second capacitor switch connected to at least one of the first, second, third or any subsequent LED circuits, and the controller, and a capacitor connected to the first and second capacitor switches. The controller may close the first capacitor switch to charge the capacitor during at least a first portion the input to the controller and the second capacitor switch closes to discharge the capacitor to at least one of the first LED circuit, the second LED circuit and the third LED circuit during at least a second portion of the input to the controller. The controller may also close the second capacitor switch to at least one different circuit of the first LED circuit, the second LED circuit and the third LED circuit during at least a third portion of the input voltage phase.

In order to protect and control the charging of the capacitor, the capacitance circuit may include a current controlling device connected in series with the capacitor. The current controlling device may be a passive element, like for example a resistor or inductor, or may be an active device like for example a current limiting diode, a constant current regulator, or a transistor or switch which permits voltage and current to reach the capacitor at desired periods. When a transistor is used, the transistor may be connected to the controller to control the times at which the capacitor is charged.

At least one additional capacitance circuit, i.e. at least a second capacitance circuit, substantially identical to the first may be provided in the LED lighting device as well. The second capacitance circuit may include some or all of the elements of the first capacitance circuit but will at least include a third capacitor switch (like the first capacitor switch) and a fourth capacitor switch (like the second capacitor switch) connected to a second capacitor. The first and third capacitor switches may be controlled in a substantially similar manner—both may be closed by the controller to charge its respective capacitor during a first portion of the input to the controller and corresponding first portion of the half cycle of an input voltage. However, when the first and third capacitor switches are turned on may be staggered in order to avoid a disruption in total harmonic distortion and achieve maximum benefit. For example, the first capacitor switch may turn on during a first part of the first portion of the input to the controller, while the second capacitor switch turns on during a second part of the first portion of the input to the controller. This insures that the current drawn by the capacitance circuits is staggered to some degree so that the total current drawn by the device is not distorted by both capacitance circuits drawing current at the same time. The second and fourth capacitor switches may act in substantially same manner as each other, however, the second and fourth capacitor switches may be controlled independent of each other. Controlling the switches independent of each other helps to further fill the "valley" which exists at the end of and between each half voltage cycle and avoid a change in light flux from the device and help eliminate any flicker. For example, the first capacitance circuit may be controlled to discharge at the end of a first half cycle of a rectified voltage waveform, both capacitance circuits controlled to discharge during the period at the very end of the first half cycle, between half cycles and at the very beginning of the second half cycle, while only the second capacitance circuit is controlled to discharge at the beginning of the second half cycle. In order to match voltages provided by one, two or more capacitance circuits, the controller may dynamically switch the connection of the first and second LED circuits. For example when once capacitance circuit is discharging the controller may close the switches required to make the first and second LED circuits in parallel, while when two capacitance circuits are discharging at the same time, the controller may open and close switches to place the circuits in a series, or when more than two LED circuits are used series-parallel, configuration.

According to one embodiment of the invention, rather than connecting LEDs in a different manner and in different configurations, a single LED circuit divided into multiple series strings of LEDs each having parallel switch bypasses may be provided. The LED lighting device may include a bridge rectifier and a first LED circuit having at least two LED strings connected in series, to the output of the bridge rectifier. A first switch may be connected in parallel with a first of the at least two LED strings, a second switch connected in parallel with a second of the at least two LED strings. A controller may be provided to dynamically control the switches in response to an input to the controller in order to bypass one or more of the LED strings while allowing any remaining LED strings to connect in series.

The LED lighting device may include a first capacitance circuit having a first capacitor switch connected to the bridge rectifier and a controller, a second capacitor switch connected to at least one LED string in the first LED circuit, and a first capacitor connected to each of the first and second capacitor switches. The device may further include a second capacitance circuit having a third capacitor switch connected to bridge rectifier and the controller, a fourth capacitor switch connected to at least one of the at least two LED strings, and the controller, and a second capacitor connected to each of the third and fourth capacitor switches. The controller may dynamically close the first and third capacitor switches to charge the first and second capacitors respectively during at least a first portion the input to the controller corresponding to a first portion of the input voltage to the LED circuit. Alternatively, the controller may stagger the first and third switches to better allow the input current to track the input voltage curve and so minimize the effects of harmonic distortion. The controller may also dynamically close the second capacitor switch to discharge the first capacitor to at least one of the at least two LED strings during at least a second portion of the input to the controller, and may dynamically close the fourth capacitor switch to discharge the second capacitor to at least one of the at least two LED strings during at least a third portion of the input to the controller. The second and third portions may partially or completely overlap in duration.

According to yet another embodiment of the invention, an LED lighting device may include a bridge rectifier and at least four LED circuits connected in parallel across the output of the bridge rectifier. Each of the at least four LED circuits includes at least one LED and has two switches connected in series with the LEI) circuit. The LED lighting device may include at least three cross-connecting switches, each cross-connecting switch connecting the output of one LED circuit to the input of an adjacent LED circuit so that each adjacent parallel LED circuit is bridged by a switch. To control the switches, a controller may be included in the device, the controller receiving an input and dynamically controlling each of the switches and cross-connecting switches to connect the at least four LED circuits to the bridge rectifier in a parallel, series-parallel or series relationship in response to the input received by the controller corresponding to the input voltage received by the LED circuits.

The LED lighting device may include at least one capacitance circuit for storing voltage and providing voltage to at least one of the at least four LED circuits. The at least one capacitance circuiting may include a first capacitor switch connected to bridge rectifier and the controller, a second capacitor switch connected to at least one of the four LED circuits and the controller, and a capacitor connected to the first and second capacitor switches. The controller may dynamically close the first capacitor switch to charge the capacitor during at least a first portion of the input to the controller corresponding to a first portion of the input voltage to the LED circuits. The controller may dynamically close the second capacitor switch to discharge the capacitor to at least one of the at least four LED circuits during at least a second portion of the input to the controller corresponding to a second portion of the input voltage to the LED circuits.

In order to protect and control the charging of the capacitor, the capacitance circuit may include a current controlling device connected in series with the capacitor. The current controlling device may be a passive element, like for example a resistor or inductor, or may be an active device like for example a current limiting diode, a constant current regulator, or a transistor or switch which permits voltage and current to reach the capacitor at desired periods. When a transistor is used, the transistor may be connected to the controller to control the times at which the capacitor is charged.

At least one additional capacitance circuit, i.e. at least a second capacitance circuit, substantially identical to the first may be provided in the LED lighting device as well. The second capacitance circuit may include some or all of the elements of the first capacitance circuit but will at least include a third capacitor switch (like the first capacitor switch) and a fourth capacitor switch (like the second capacitor switch) connected to a second capacitor. The first and third capacitor switches may be controlled in a substantially similar manner—both may be closed by the controller to charge its respective capacitor during a first portion of the input to the controller and corresponding first portion of the half cycle of an input voltage. However, when the first and third capacitor switches are turned on may be staggered in order to avoid a disruption in total harmonic distortion and achieve maximum benefit. For example, the first capacitor switch may turn on during a first part of the first portion of the input to the controller, while the second capacitor switch turns on during a second part of the first portion of the input to the controller. This insures that the current drawn by the capacitance circuits is staggered to some degree so that the total current drawn by the device is not distorted by both capacitance circuits drawing current at the same time. The second and fourth capacitor switches may act in substantially same manner as each other, however, the second and fourth capacitor switches may be controlled independent of each other. Controlling the switches independent of each other helps to further fill the "valley" which exists at the end of and between each half voltage cycle and avoid a change in light flux from the device and help eliminate any flicker. For example, the first capacitance circuit may be controlled to discharge at the end of a first half cycle of a rectified voltage waveform, both capacitance circuits controlled to discharge during the period at the very end of the first half cycle, between half cycles and at the very beginning of the second half cycle, while only the second capacitance circuit is controlled to discharge at the beginning of the second half cycle. In order to match voltages provided by one, two or more capacitance circuits, the controller may dynamically switch the connection of the first and second LED circuits. For example when once capacitance circuit is discharging the controller may close the switches required to make the first and second LED circuits in parallel, while when two capacitance circuits are discharging at the same time, the controller may open and close switches to place the circuits in a series, or when more than two LED circuits are used series-parallel, configuration.

In order to further control the flux output of the lighting device and also insure that any capacitance circuits are discharged over the entire required period at the beginning and end of each half cycle, the LED lighting device may also include a dimmer control which regulates the voltage and current provided to each LED circuit. The dimmer control may be dynamically controlled by the controller and may be used to reduce the voltage and current provided to the LED circuits during at least one portion of the phase of an input AC voltage. For example the dimmer control may reduce the current provided from the capacitor(s) to the LED circuit(s) when a voltage half cycle is at the beginning or end. While this may marginally affect the total light flux of the lighting device, it may help to insure that no flicker occurs and that the device always provides at least some light. Dimmer control is particularly useful when the lighting device is controlled by a dimmer switch to reduce the light output and/or cut the input voltage phase.

Other advantages and aspects of the present invention will become apparent upon reading the following description of the drawings and detailed description of the invention.

BRIEF DESCRIPTION OF THE DRAWINGS

FIG. 4A shows the light flux of the device shown in FIG. 3B relative to an input voltage;

FIG. 4B shows the current drawn by the device shown in FIG. 3B;

FIG. 5 shows a capacitance circuit which may be used with each embodiment of the present invention alone or in multiples;

FIG. 6A shows the light flux of the devices shown in FIGS. 3A and 3C;

FIG. 6B shows the current draw of the devices shown in FIGS. 3A and 3C;

FIG. 6C shows the current delivered by the capacitance circuits in the embodiments shown in FIGS. 3A and 3C;

DETAILED DESCRIPTION OF PREFERRED EMBODIMENTS

While this invention is susceptible to embodiments in many different forms, there is described in detail herein, preferred embodiments of the invention with the understanding that the present disclosures are to be considered as exemplifications of the principles of the invention and are not intended to limit the broad aspects of the invention to the embodiments illustrated.

Figure 1:
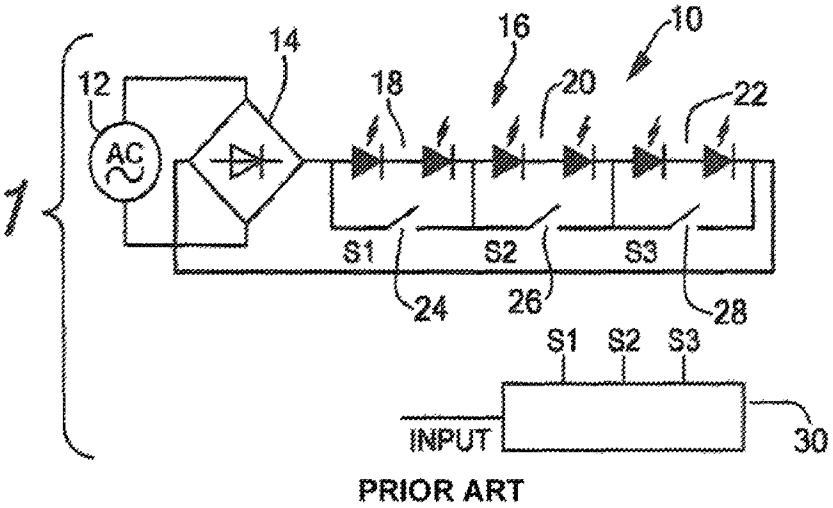
FIG. 1 shows a schematic of a prior LED lighting device.

FIG. 1 shows an exemplary prior art configuration which is known in the art as a linear step drive. As seen in FIG. 1, the overall system 10 is provided with AC voltage from a voltage source 12. The AC voltage is rectified by rectifier 14 and provided to a series string of LEDs 16. Series string 16 is divided into three groups 18, 20, 22 which each have a switch 24, 26, 28 respectively connected in parallel. Each of the switches are generally controlled by controller 30 to open and close as an input to the controller, like for example the rectified voltage, changes, with the switches all beginning closed. As the rectified voltage provided by rectifier 14 increases and finally matches the forward operating voltage of the LEDs in group 18, switch 24 will be opened by controller 30, causing the current to flow through the LEDs in group 18, thereby causing the LEDs to begin emitting light. As the input voltage further increases and eventually matches the forward voltage required to drive groups 18 and 20, the controller will cause switch 26 to also open, causing current to flow through both groups 18 and 20, thereby causing light to emit from the LEDs in both groups. Eventually switch 28 will be opened, followed by the controller causing the switches to close again as the input voltage drops below forward operating voltages during the second half of the half cycle of the input AC voltage.

As the voltage increases and groups 18, 20 and 22 are connected in series, the amount of current flowing through the circuit, and therefore each LED, will increase and decrease as switches are opened and closed to match the voltage. As a result of the voltage and current increasing and decreasing, the total overall power dissipated by circuit 16 will constantly be increasing and decreasing. Furthermore, since LED circuits are turned on and off to match the increasing and decreasing input voltage, the total light flux will constantly increase and decrease. Regardless, in each case the light output of the circuit will constantly be changing—including dropping to zero when the input voltage is below the forward operating of group 18, for example.

Figure 2:
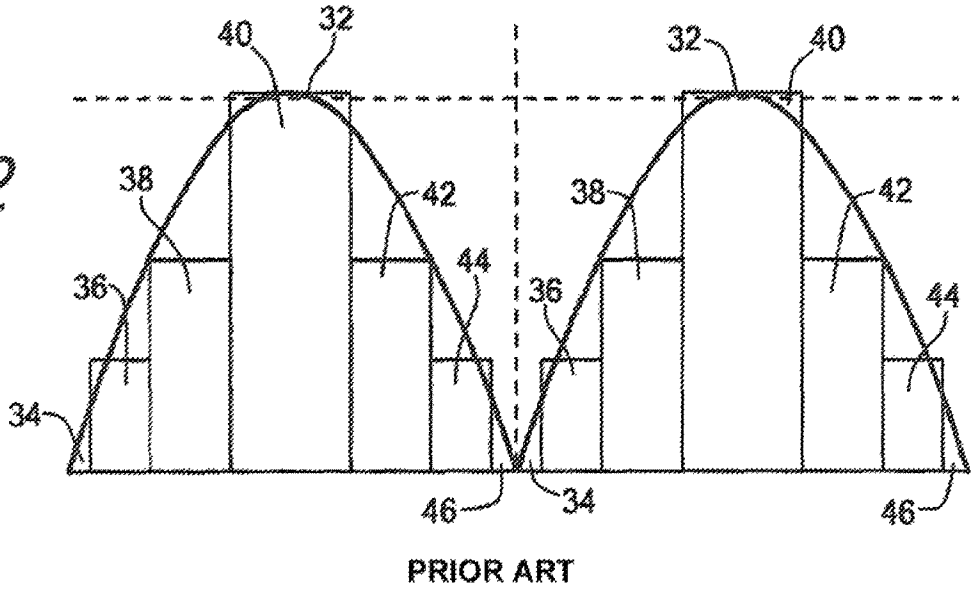
FIG. 2 shows a graphical representation of the light flux of the prior art device shown in FIG. 1.

FIG. 2, for example, shows a graphical representation of the light output which results from the circuit in FIG. 1 over the course of an entire input voltage cycle. As seen in FIG. 2, as the input voltage 32 begins to rise in portion 34, before the forward operating voltage of any of groups 18, 20 or 22 are met by the input voltage, no light is emitted by device 16. Once the forward operating voltage of group 18 is reached and group 18 is turned on during portion 36 of the input voltage, the light flux remains substantially constant at a first level resulting from the LEDs in group 18 being driven. When the forward operating voltage increases enough to match the forward operating voltage of groups 18 and 20, the amount of light flux increases to a second, higher, substantially constant level during portion 38 of the phase. Once the input voltage reaches a level where groups 18, 20 and 22 can be forward driven during portion 40 of the phase, the light flux reaches its maximum peak before beginning to decrease as group 22 is first turned off during portion 42 and group 20 is turned off during portion 44, and finally all three groups are turned off during portion 46 before the next half cycle reaches an input voltage where group 18 alone can again be forward driven. The light flux emitted by the overall device constantly changes throughout the cycle.

The embodiments of the present invention aim to not only address the period where the total light output is zero from a circuit or circuits, or a device overall, but also to make sure that the light flux output of the circuit, circuits or device is substantially constant as the voltage rises and falls. In order to achieve this, the present invention provides various embodiments wherein the total power dissipated by the circuit, circuits or device remains substantially constant throughout an entire input voltage cycle.

Figure 3A:
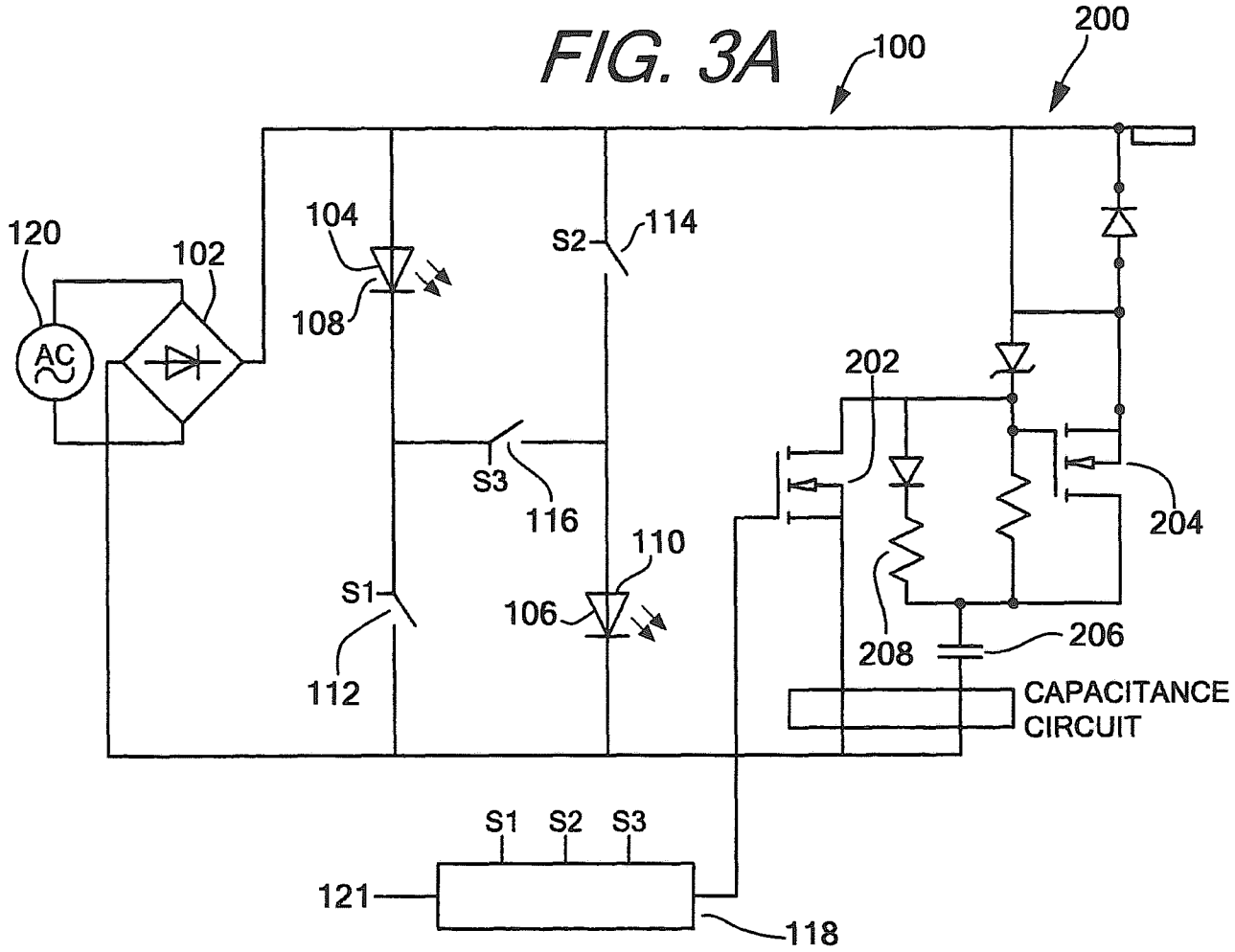
FIG. 3A shows a basic schematic of an embodiment of and LED lighting device contemplated by the invention.
Figure 3B:
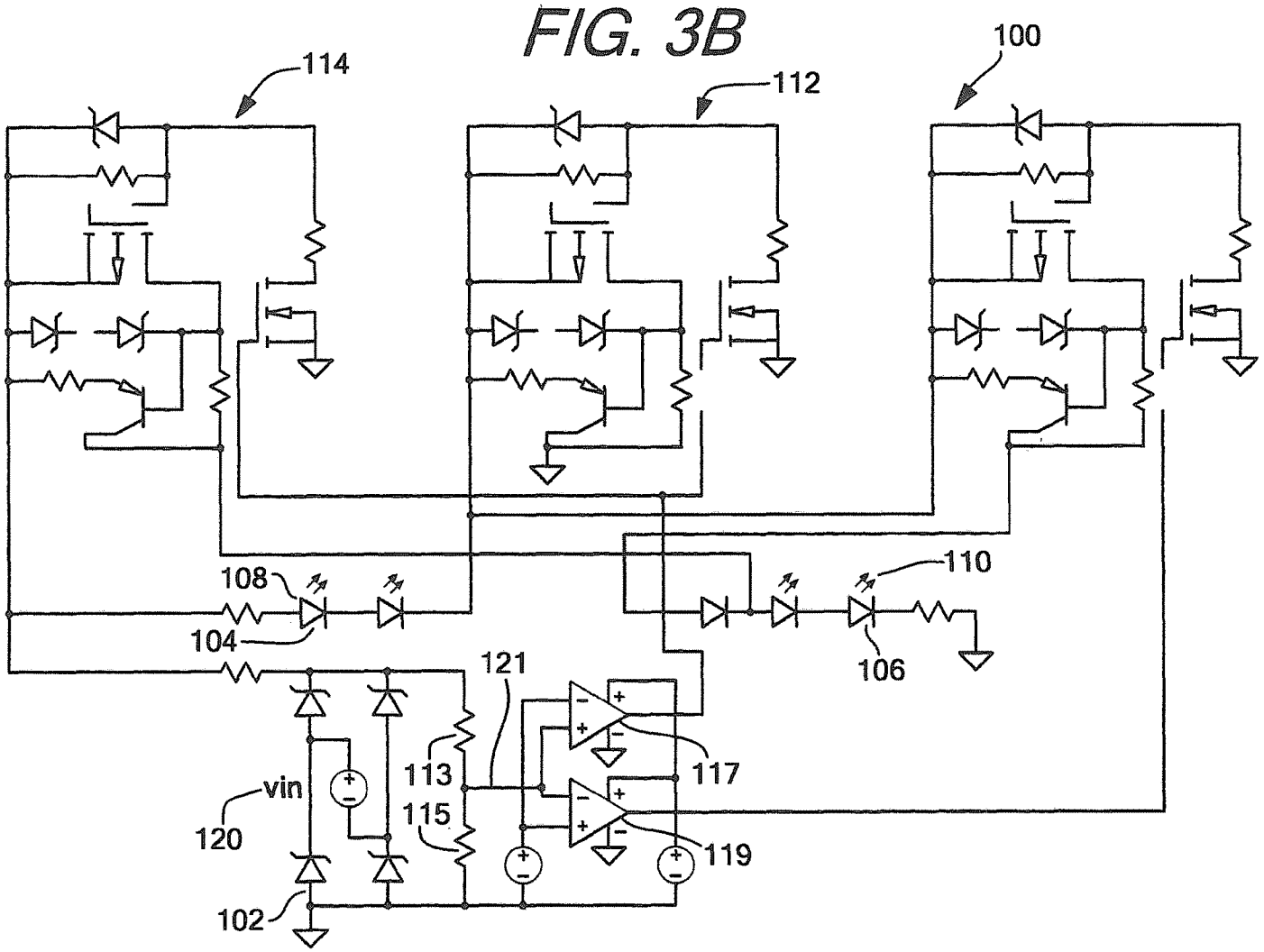
FIG. 3B shows a schematic of the embodiment shown in FIG. 3A without a capacitance circuit.
Figure 3C:
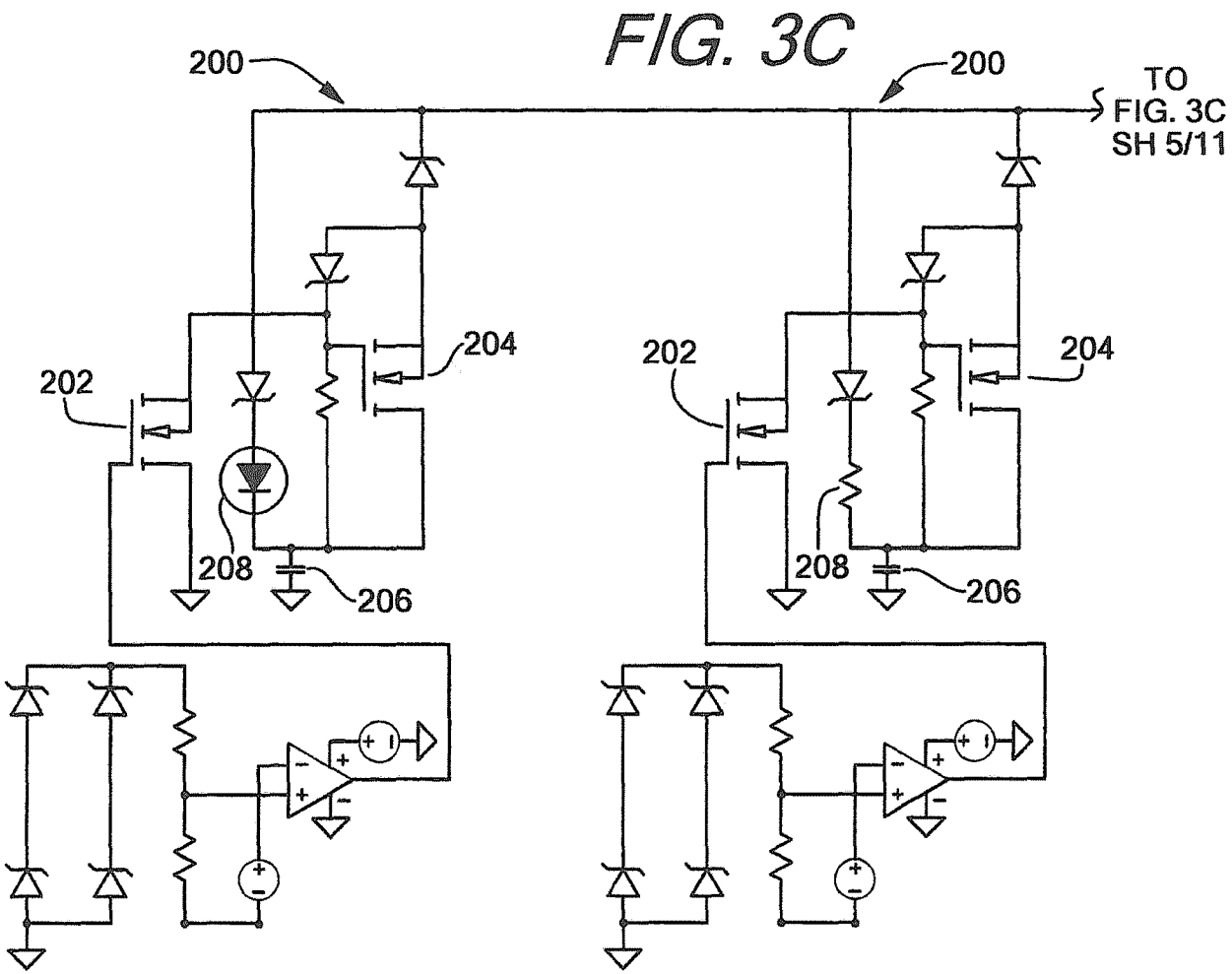
FIG. 3C shows a schematic of the embodiment shown in FIG. 3A with two capacitance circuits.
Figure 3C:
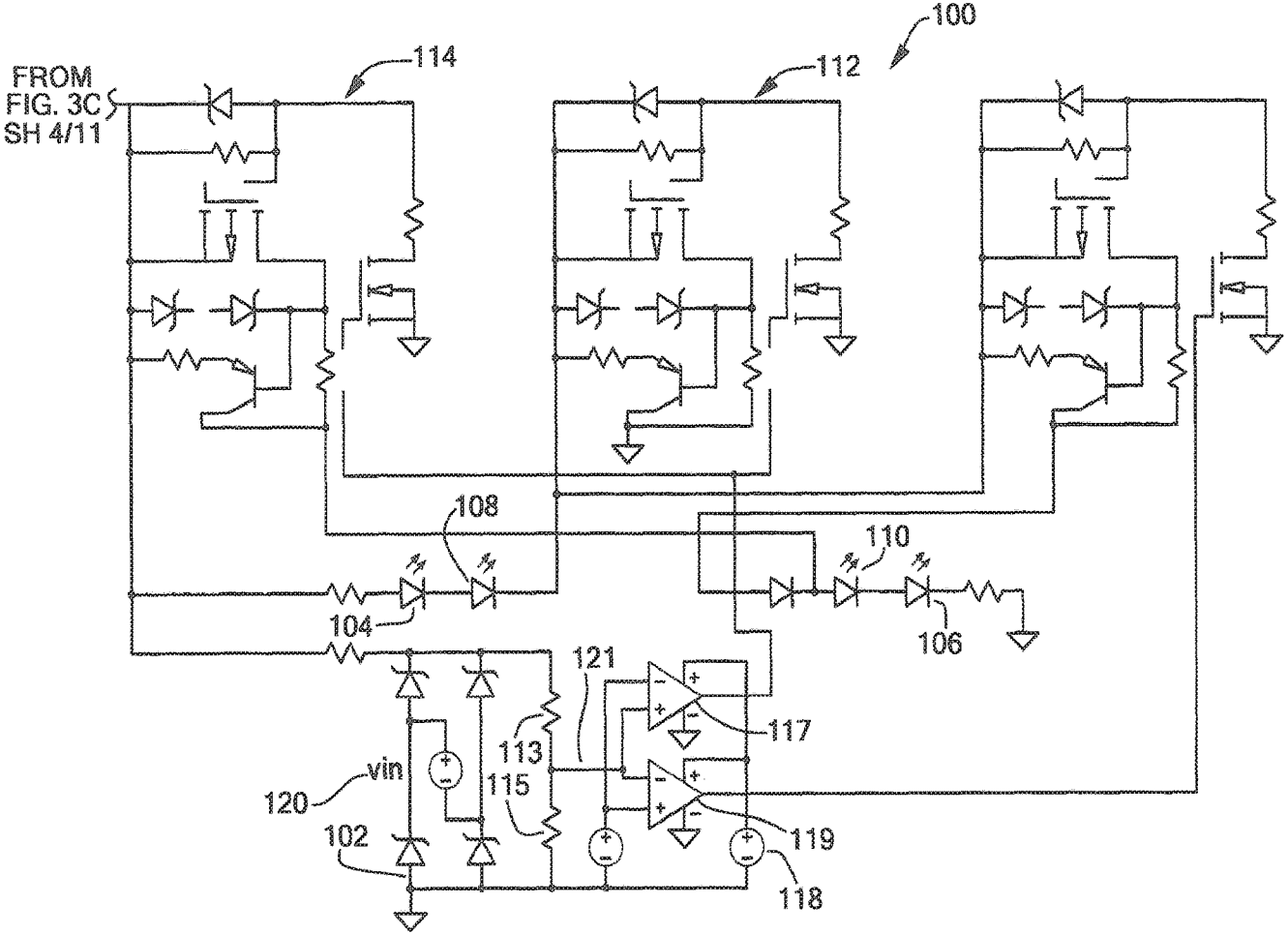

FIGS. 3A-C show configurations of a first embodiment of the present invention which can be configured to address one or all of the aforementioned problems in a linear step drive circuit or device.

As seen in FIGS. 3A-C, device 100 includes rectifier 102 and LED circuits 104, 106 connected in parallel, each circuit having at least one LED 108, 110 respectively. Though shown as a single LED, it should be understood that LED circuits 104, 106 may include any number of LEDs connected in series. The circuits may include an identical or different numbers of LEDs, may be LEDs having substantially the same or different characteristics, like for example emit light of a different color.

Each LED circuit 104, 106 is connected in series with a switch, shown as switches 112, 114, respectively. A third switch 116 may connect the output of one LED circuit to the input of the second LED circuit in order to connect LED circuits 104, 106 in a series relationship. Switches 112, 114 may be dynamically controlled by a controller 118 which may be a chip as shown in FIG. 3A or be formed using various components as shown in FIGS. 3B and 3C. Though shown in a particular configuration in FIGS. 3B and 3C, it should be understood that switches 112, 114 and 116 may be configured in any manner known in the art.

Controller 118 may likewise be a chip, as shown in FIG. 3A which measures input voltage or a modified input voltage, or has a timer set in phase with the input voltage and opens and closes the switches based on the phase of the voltage input rather than measuring the voltage or a modified voltage. As shown in FIGS. 3B and 3C the controller may be built as something like a comparator which uses a scaled down input voltage to determine the input voltage and generate a control signal to control switches 112, 114 and 116. For example, controller 118 may include a voltage divider using resistors 113 and 115 may be used to scale the input voltage down, and provide the scaled voltage to operations amplifiers 117 and 119 for use as a comparator circuit. When the input voltage reaches a first level, the comparator will output a first control signal to switches 112, 114, causing the switches to close connecting LED circuits 104, 106 in parallel. As the voltage, and therefore the input to the comparator, continues to increase, once a second input threshold is reached, controller 118 may generate a second control signal which will open and close switches 112, 114 and 116 to connect LED circuits 104, 106 in series. When the voltage falls during the second half of the first half cycle, when the input voltage drops back below the forward operating voltage of LED circuits 104, 106 combined, the input to the controller should likewise drop below the second threshold causing the controller to open and close switches 112, 114 and 116 to place LED circuits 104, 106 hack in parallel.

Regardless of configuration, any combination of controller 118, switches 112, 114, 116, bridge rectifier 102, and any capacitance circuits 200 may be integrated on a single integrated chip in device 100, as well as in devices 300, 400, 600 as discussed herein.

Device 100 operates as follows. As the voltage provided by AC voltage source 120 begins to increase and the input voltage to LED circuits 104, 106 matches that of forward operating voltage of each individual circuit 104, 106, input 121 to controller 118 will likewise reach a first value, causing controller 118 to dynamically (automatically) close switches 112, 114, connecting LED circuits 104, 106 to each other in a parallel relationship relative to bridge rectifier 102. Since the circuits are connected in parallel during this portion of the cycle or phase of the input voltage, the amount of voltage required to drive each circuit is lowered, while the total current consumed by the device is the current required to drive both LED circuits.

As the voltage continues to increase and when the input voltage to the LED circuits reaches a level which matches or exceeds the forward operating voltage of LED circuits 104, 106 combined, the input to controller 118 will reach a second value, causing controller 118 to dynamically open switches 112, 114 and dynamically close switch 116, connecting LED circuits 104, 106 in series relative to bridge rectifier 102. Connecting LED circuits 104, 106 in a series relationship will result in the forward operating voltage of the device increasing to match the increasing amount of voltage provided by the AC voltage source. When connected in series the total voltage drop of the LED circuits 104, 106 will increase by compared to when connected in parallel, however the total current flowing through the LED circuits will decrease as a result of a single circuit being powered rather than two parallel circuits. As a result, as long as a substantially constant amount of current is provided to each LED in both circuits throughout the entire process, the overall power consumed by the device will remain substantially constant.

As the voltage begins to fall during the second half of the first half cycle of the input voltage, when the input voltage falls below the forward operating voltage of LED circuits 104, 106 combined, the input to controller 118 will reach a third value—which may in some embodiments be substantially equal to the first value, while in other embodiments be a different value—which will cause switch 116 to open and switches 112, 114 to close to disconnect LED circuits 104, 106 from a series relationship, and re-connect in a parallel relationship.

Though this embodiment has been described with respect to three switches, LED circuits 104, 106 may be configured into parallel and series relationships using only switches 112, 114 with a wire or other solid state connection connecting the output of one LED circuit to the input of the other. In this configuration, switches 112, 114 may open and close as necessary to facilitate a parallel configuration between LED circuits 104, 106 relative to bridge rectifier 102. When the forward operating voltage is high enough to drive LED circuits 104, 106 in series relative to bridge rectifier 102, both switches 112, 114 may be dynamically opened by controller 118, forcing current through the series connected LED circuits 104, 106.

Provided that each LED within each circuit receives a substantially constant level of current, the total light flux emitted by the device will likewise remain substantially constant as LED circuits 104, 106 are switched between parallel and series relationships. As both LED circuits 104, 106 are always on, the current in each LED remains substantially constant as the total power dissipated by the LED circuits likewise remains constant. This can be seen in FIG. 4A, for example, where portions 122 and 126 in each half cycle represent the light output when LED circuits 104, 106 are connected in parallel while portion 124 in each half cycle represents the total light output when LED circuits 104, 106 are connected in series.

Though the issue with a nearly constant change in light flux that exists in the known prior art is solved when enough voltage is provided to power one of LED circuits 104, 106, operating the circuit shown in FIG. 3B, for example, in the manner described, for example, does not solve for flicker when the input voltage is below the forward operating voltage of either circuit and creates a new problem.

As shown in FIG. 4B, re-configuring LED circuits from a parallel to series relationship as the voltage increases causes the power factor ("PF") to dramatically decrease while the total harmonic distortion ("THD") of the device dramatically increases. As seen in FIG. 4B, when LED circuits 104, 106 are connected in parallel, the total current drawn is at its peak as shown in portions 122' and 126', while the total drawn current substantially decreases as the voltage increases and controller 118 manipulates switches 112, 114 and 116 to connect LED circuits 104, 106 in series, as shown during portion 124'. While this is beneficial as it creates an immediate high current spike and gets LED circuits 104, 106 emitting light immediately at a level which can be maintained substantially constant, the result of controlling and driving device 100 in this manner is that the current waveform becomes inverted from the voltage waveform.

To solve the first problem of flicker, in order to provide power during portion 128 in FIG. 4A for example, to drive LED circuits 104, 106 during the period in which the voltage input is less than the forward operating voltage of either of LED circuits 104, 106, at least one capacitance circuit like that shown in FIG. 5 may be integrated in device 100 as shown in FIGS. 3A and 3C. Controlling the charging and discharging of this capacitance circuit may also substantially correct the power factor and total harmonic distortion of the device, solving the second problem which may exist in the device shown in FIG. 3B, for example.

As seen in FIG. 5, and FIGS. 3A and 3C, capacitance circuit 200 may include a first capacitor switch 202 and a second capacitor switch 204 which are both connected to capacitor 206. When capacitance circuit 200 is included in an LED device like device 100 as shown in FIG. 3A, capacitor switches 202, 204 may be dynamically controlled by controller 118 to connect capacitance circuit 200 to, for example, rectifier 102 during one portion of the input voltage half cycle and the connect the capacitance circuit to at least one of LED Circuits 102, 104 during at least a second portion of the half cycle as well as between half cycles. Alternatively, as shown in FIG. 3C for example, each individual capacitance circuit may include its own controller and bridge rectifier. The individual controllers may control its respective capacitance circuit in a similar manner as controller 118.

In operation, following from FIGS. 6A-C, for example, controller 118 or a designated unique controller will dynamically close first switch 202, connecting capacitance circuit 200 to bridge rectifier when the input to the controller reaches the second value, for example at the leading edge of portions 124 and 124' in FIGS. 6A and 6B. Closing switch 202 and charging capacitor 206 when the input voltage is at its peak helps correct the power factor device 100 as capacitance circuit 200 will draw current from the input in order to charge capacitor 206. The current drawn by capacitance circuit 200, shown as portion CC in FIG. 6B, will cause the current drawn by device 100 closer match the provided voltage, reducing total harmonic distortion and increasing the power factor.

In order to control the charging, capacitance circuit 200 may include current controlling device 208 to both protect capacitor 206 and extend the charge time so that capacitance circuit 200 continues to draw current throughout the entire portion 124, 124' to maximize the power factor and harmonic distortion improvement realized by the inclusion of the capacitance circuit. Current controlling device 208 may be either passive or active. For example, as shown in FIG. 5, the current controlling device may be a passive element like a resistor, or alternatively may be an inductor. The current controlling device may instead be an active device, like for example a current limiting diode as shown in one of capacitance circuit 200 in FIG. 3C. Active and passive devices may be used interchangeably between devices and capacitance circuits, with the primary objective being protection of the capacitor and extending the charge time. Each capacitance circuit discussed with any of the embodiments herein may include active or passive current control, or a combination of both, regardless of embodiment.

As the input to the controller reaches a third value—or merely falls below the second value depending on the controller input—corresponding to a drop in input voltage to LED circuits 104, 106, controller 118 or a respective unique controller will dynamically open first switch 202 to disconnect capacitance circuit from rectifier 102. After the input to the controller reaches the third value and/or falls below the second threshold, the controller will dynamically re-connect LED circuits 104, 106 in a parallel configuration using switches 112, 114, substantially increasing the current drawn by the LED circuits, again causing the power factor to decrease significantly. In order to compensate and maintain a substantially satisfactory power factor, controller 118 or a designated unique controller may dynamically close switch 204 connecting capacitance circuit 200 to at least one, or both, of LED circuits 104, 106, in order to supplement the current drawn from the device input, providing for example portion CD in FIG. 6C. Connecting capacitance circuit 200 to LED circuits 104, 106 during portions 126, 126' shown in FIGS. 6A-C, for example, will allow capacitor 206 to begin discharging and provide a substantial level of current to device so that the amount of current drawn from the input can be substantially reduced, and therefore the power factor of the device substantially improved.

In order to eliminate flicker and insure that LED device 100 continues to emit light during the "valley" or portion 128, 128' between the first half cycle where the input to controller 118 (or a unique controller for the capacitance circuit) reaches a fourth value and/or drops below the first threshold corresponding to the input voltage dropping below the forwarding operating of LED circuits 102, 104 individually. The controller controlling the capacitance circuit may continue to keep second switch 204 closed so that capacitor 206 continues to discharge to at least one of LED circuits 102, 104. As the capacitor continues to discharge and provide power to LED circuits 102, 104, LED device will continue emitting light until the input to the controller reaches the first value or threshold, corresponding to the input voltage to the LED circuits reaching the forward operating voltage of LED circuits 104, 106 individually during portion 122, 122' of the second half cycle of the voltage input. The controlling controller will keep second switch 204 closed after the input to the controller reaches the first value and/or threshold, and as a result capacitor 206 connected to LED circuits 104, 106 throughout portion 122' in the second half cycle of the input voltage in order to again substantially improve the power factor and total harmonic distortion of the device. Switch 214 will then be dynamically opened and switch 212 dynamically closed again as portion 124, 124' is reached in the second half cycle and the input to the controller again reaches the second threshold as a result. This will re-charge the capacitor and substantially improve the power factor and total harmonic distortion.

In order to insure that enough charge is stored so that the capacitance circuit provides enough power through portions 126', 128', and 122' during the second half cycle of the input voltage, a properly sized capacitor 206 may be selected, or more preferably a second or additional capacitance circuits may be added as seen in FIG. 3C. As seen in FIG. 3C, a second or subsequent capacitance circuits 200 may be connected in parallel with capacitance circuit 200 and may be substantially identical and operate in a similar manner. For example, whether one, two or more capacitance circuits are provided, a controller may control the first capacitor switch in each circuit to close and charge the capacitor when the voltage is at a maximum and the current drawn is at a minimum. Alternatively, in order to avoid too much harmonic distortion, the closing of the first switches in each capacitance circuit may be slightly staggered. The controller may likewise control the second switch in each circuit to begin the discharge of the capacitor independently as well to spread discharge of each capacitor out.

As discussed above, when portion 126' in FIG. 6B, for example, is reached and the input to the controller is at the third value and/or below the second threshold, the controller may close the second switch on capacitance circuit 200 so that capacitor 206 may begin discharging. In order to avoid having to use large capacitors while insuring that some charge remains to supplement the circuit input at portion 122' and that the entire portion 128' is bridged, for example, controller 118 may leave the second switch in a second capacitance switch open during portion 126' to delay the discharge of the capacitor included in the second capacitance circuit. Controller 118 may instead close the second switch in the second capacitance circuit to begin discharging the second capacitor during, for example, portion 128', when an input to the controller reaches a fourth value corresponding to the moment zero voltage is input into LED circuits 104, 106. If discharge begins late, a reduction in flux at the end of portion 128' and a maximization of improved power factor and total harmonic distortion of the device may be achieved, as the second capacitor will have a greater amount of charge remaining during portions 128' and 122' during the second half cycle to provide power to LED circuits 104, 106 and supplement the input voltage. Controller 118 may control the second switches of each capacitance circuit independently so as to effectuate a longer discharge period from the first, second and any subsequent capacitance circuits.

In order to further facilitate improvement of power factor and total harmonic distorting, and extend discharge of any capacitance circuits provided in device 100, controller 118 may dynamically open and close switches 112, 114, 116 to change the configuration of LED circuits 102, 104 from parallel to series and back again in device 100 as the capacitor discharges. For example at portion 126' in FIG. 6C, rather than connect LED circuits 104, 106 in parallel, controller 118 may instead leave LED circuits 104, 106 in series, reducing the amount of supplement current required from capacitor 206 in order to achieve a better power factor. Dynamically controlling and manipulating the switches to modify the configuration of the circuits with respect to each other can be particular helpful if additional circuits and switches are added to allow more configurations. A better power factor and more control can be provided if additional circuits and switches are added to a device like that shown in FIGS. 3A-C, like for example by creating a device having at least four circuits like that shown in FIGS. 7A and 7B.

Figure 7A:
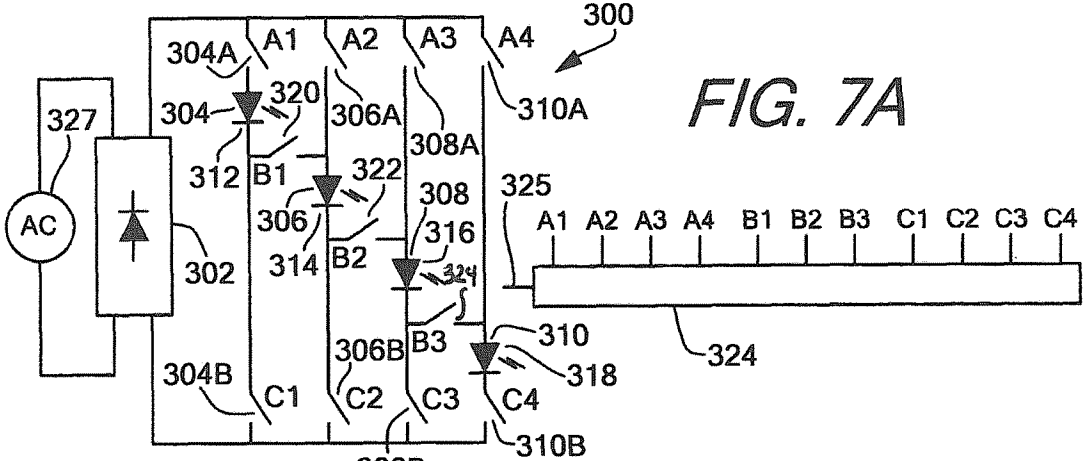
FIG. 7A shows a schematic of an embodiment of and LED lighting device contemplated by the invention.
Figure 7B:
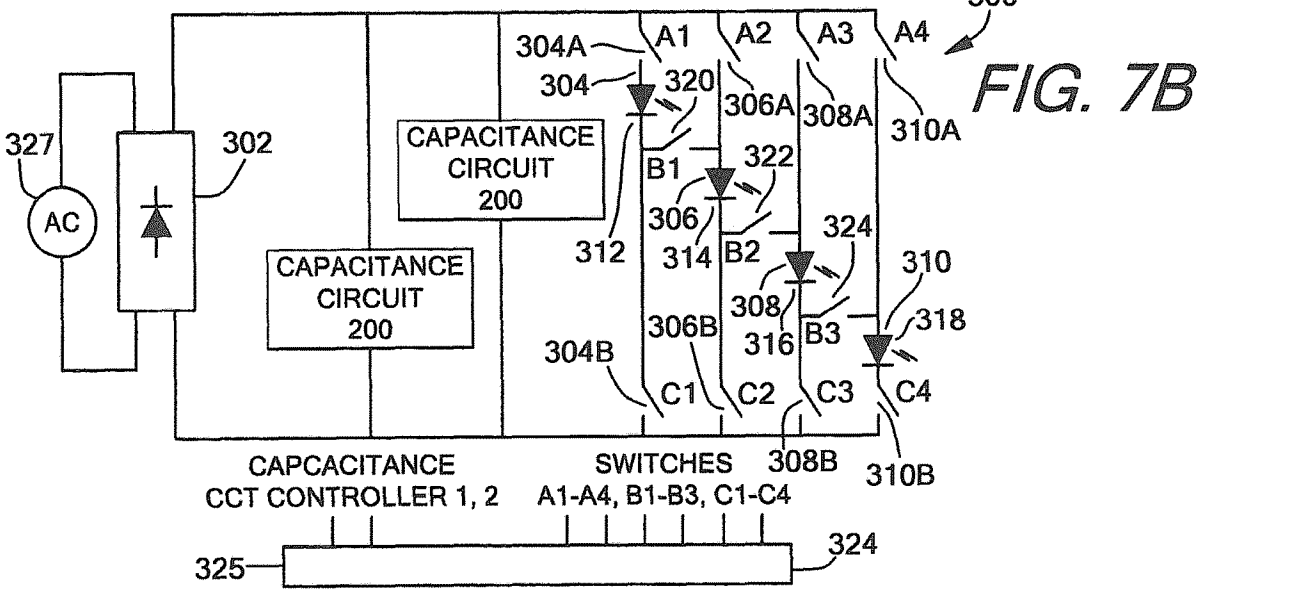
FIG. 7B shows a basic schematic of the embodiment shown in FIG. 5A with two capacitance circuits added.

As seen in FIGS. 7A and 7B, device 300 is substantially similar to device 100 shown in FIGS. 3A-C with additional LED circuits and switches added. Device 300 includes a rectifier 302 and at least four LED circuits 304, 306, 308, 310, each having at least one LED 312, 314, 316, 318 respectively. Though shown as one, like the embodiment shown in FIG. 3A, it should be understood that each circuit may include any number of LEDs, and the circuits may include different numbers of LEDs and/or LEDs having different characteristics. The circuits may also be schematically designed like those shown in FIGS. 3B and 3C with the additional LED circuits and switches added thereto. Each LED circuit includes at least one LED and has at least two switches connected in series with the circuit, denoted in FIGS. 7A and 7B as A and B for each respective circuit. It is advantageous if the switches are configured so that one switch, for example switches 304A, 306A, 308A, 310A, is formed at an input side of the circuit, and the second switch, for example switches 304B, 306B, 308B, 310B, is formed at an output side for each circuit.

Device 300 may include multiple cross-connecting switches which are configured to open and close connections between the output of the last LED in one LED circuit and the input of the first LED in an adjacent LED circuit within the device. As seen in FIG. 7A, for example, switch 320 may be controlled to connect the output of LED 312 in LED circuit 304 to the input of LED 314 in circuit 306; switch 322 may be controlled to connect the output of LED 314 in circuit 306 to the input of LED 316 in LED circuit 308; and switch 324 may be controlled to connect the output of LED 316 in LED circuit 308 to the input of LED 318 in LED circuit 310.

Controller 324 within device 300 may dynamically control each of these switches—eleven total in each of FIGS. 7A and 7B—to change the configuration and connections between the switches as an input to the controller corresponding to an input voltage to the LED circuits fluctuates. Dynamic control may be exercised in a similar manner as described with respect to device 100 above, however, with additional LED circuits and additional switches in the array, additional configurations may be realized by the device. Though only four circuits are shown in FIGS. 7A and 7B, it should be understood that the invention contemplates that any number of additional circuits may be added to device 300 in parallel with LED circuits 304, 306, 308, 310, along with the corresponding cross-connecting switches to add further possible combinations of circuit connections and over dynamic control to the device.

In operation, controller 324 will control LED circuits 304, 306, 308, 310 as follows. As input 325 to controller 324 reaches a first value and/or threshold indicating that the input voltage provided by voltage source 327 has increased to match the forward operating voltage of at least one or all of individual LED circuit 304, 306, 308, 310, controller 324 will dynamically close switches 304A and 304B, 306A and 306B, 308A and 308B, and 310A and 310B to connect the at least four LED circuits in a first configuration, connecting each LED circuit in parallel the others relative to bridge rectifier 302.

As the voltage input to the circuit continues to increase, once the input the controller reaches a second value and/or threshold indicating that the input voltage to the LED circuits matches a forward operating voltage some number of combined LED circuits less than all of the LED circuits, controller 324 will dynamically control and manipulate the switches to connect LED circuits 304, 306, 308, 310 in a second configuration. The second configuration will place the LED circuits in a series parallel configurations to match the increased voltage and reduce the total current drawn by the LED circuits so that a substantially constant level of power dissipation by LED circuits 304, 306, 308, 310 is maintained. In order to connect LED circuits 304, 306, 308, 310 in a series parallel relationship, once the input to the controller reaches the second value and/or threshold, controller 324 will dynamically open switches 304B and 306A while closing switch 320 so that LED circuits 304 and 306 are connected in series. Controller 324 will simultaneously dynamically open switches 308A and 310B while closing switch 324 so that LED circuits 308 and 310 are connected in series. By leaving switch 322 open and keeping switches 304A, 306B, 308A and 310B closed, the series connected LED circuits 304 and 306 will be connected to series connected LED circuits 308 and 310 in parallel relative to bridge rectifier 302.

As the input voltage to the LED circuits continues to increase, once the input to the controller reaches a third value and/or threshold indicating that the input voltage to the LED circuits matches the total forward operating voltage of all of the LED circuits combined, controller 324 will dynamically control and manipulate the switches once against to connect LED circuits 304, 306, 308, 310 in a third configuration, this time connecting all the LED circuits in series together relative to bridge rectifier 302. Connecting LED circuits 304, 306, 308, 310 in series with each other will match the continued increasing voltage and further reduce the total current drawn by all the LED circuits so that the total power dissipation of the LED circuits once again remains substantially constant. In order to connect LED circuits 304, 306, 308, 310 all in series with each other, from the second configuration controller 324 will dynamically open switches 306B and 308A while closing switch 322. At this point, controller 324 will have switches 304A, 320, 322, 324 and 310B closed while the rest remain open.

As the input voltage begins to fall during the second half of the voltage input half cycle, when the input to the controller reaches a fourth value and/or falls below the third threshold, the controller will dynamically open and close switches to place LED circuits 304, 306, 308, 310 back in the second configuration, i.e. the series parallel relationship relative to bridge rectifier 302. In order to move back to the series parallel relationship, controller 324 will dynamically open switch 322 and dynamically close switches 306B and 308A.

As the input voltage continues to fall during the second half of the voltage input half cycle, when the input to the controller reaches a fifth value and/or falls below the second threshold, the controller may dynamically open switches 320 and 324 while dynamically closing switches 304B, 306A, 308B and 310A to place LED circuits 304, 306, 308, 310 back in a complete parallel relationship.

Where one or more capacitance circuits like capacitance circuit 200 is included in device 300, like for example shown as blocks in FIG. 7B, rather than return to the first configuration when the input to controller 324 reaches the fifth value and/or drops below the second threshold during the second half of the input voltage half cycle, controller 324 may dynamically open and close switches to place LED circuits 304, 306, 308, 310 in the third configuration, i.e. all in series. Placing all the LED circuits in series will reduce the total required supplemental current from a first, second, or subsequent capacitors while the capacitors provide the required additional voltage to match the forward operating voltage of LED circuits 304, 306, 308, 310 when connected in series.

Figure 10A:
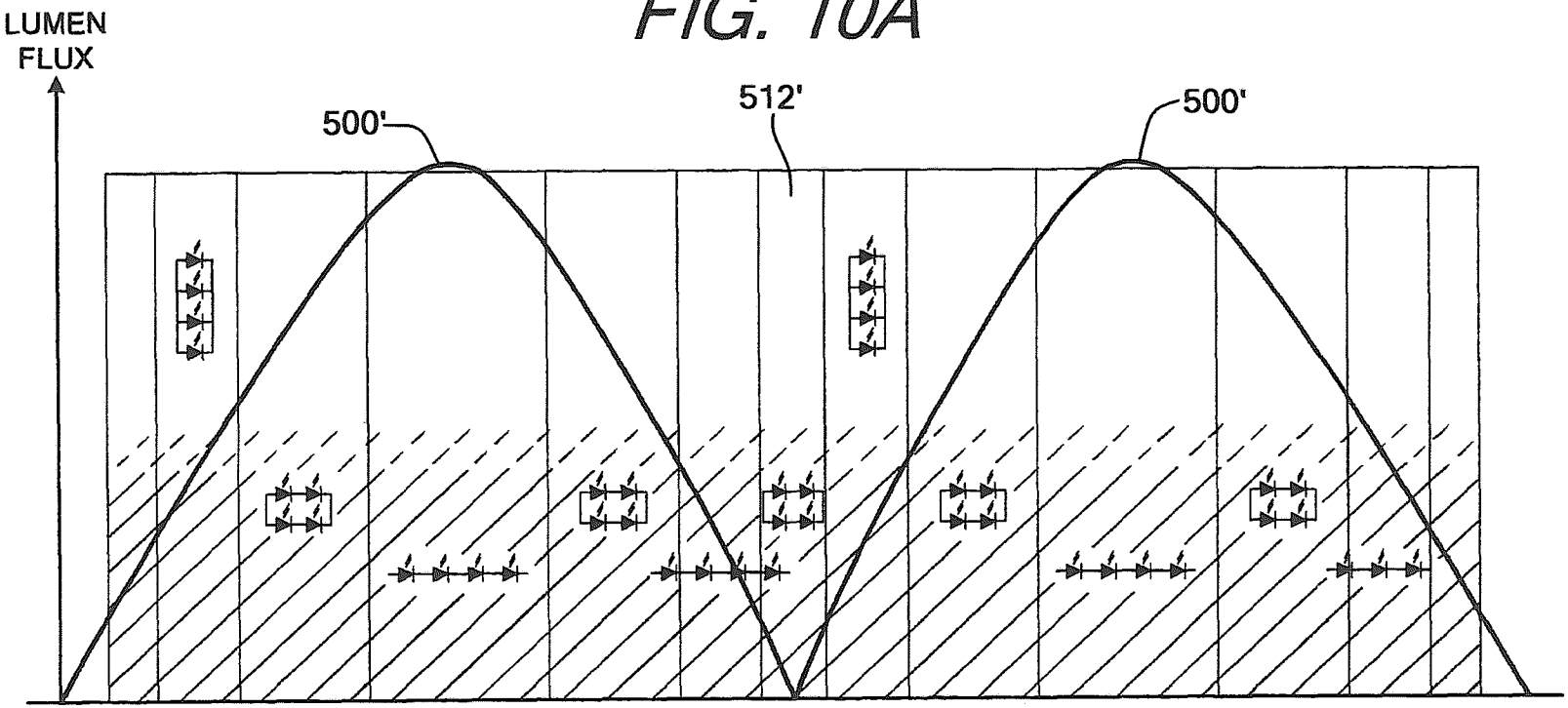
FIG. 10A shows the light flux output of the devices shown in FIGS. 7B and 8 relative to an input voltage with at least one capacitance circuit as contemplated by the invention.

When one or more capacitance circuits like capacitance circuit 200 in FIG. 5 are included in device 300, it has been found that it is advantageous if controller 324 places LED circuits 304, 306, 308, 310 in the second configuration, i.e.

in series parallel relationship, when the input to the controller reaches a sixth value and/or drops below the first threshold, for example, during the "valley" portion or portion 506 in FIGS. 10A and 10C, for example. When any connected capacitor is allowed to discharge through the second configuration, i.e. when LED circuits 304, 306, 308, 310 are connected in series parallel, the series strings (LED circuits 304 and 306 forming one and LED circuits 308 and 310 forming the other) will configure to match the applied voltage from the capacitor (and the drive voltage) drawing lower current at the higher applied voltage, keeping the light flux at a reasonably constant level. Though moving to the second configuration is advantageous, it should be understood that controller 324 may dynamically connect LED circuits 304, 306, 308, 310 in any configuration during this period.

Figure 8:
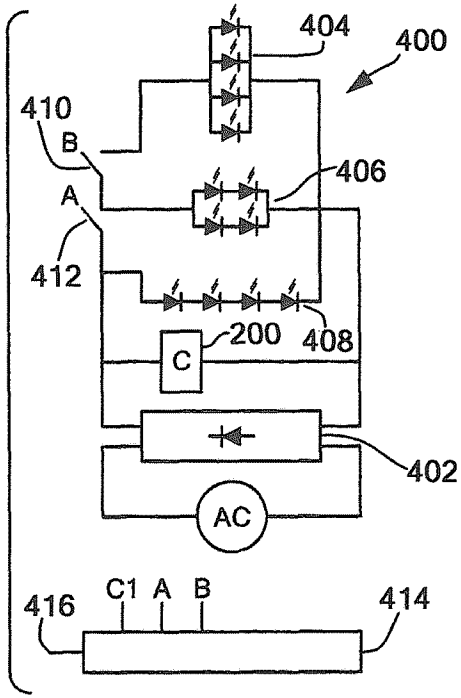
FIG. 8 shows a schematic of an embodiment of and LED lighting device contemplated by the invention.

As an alternative to the devices shown in FIGS. 7A and 7B, FIG. 8 shows an LED lighting device wherein the included LED circuits are pre-configured in the first, second and third configurations, substantially reducing the number of required switches and the amount of dynamic control which must be exercised by the controller.

As seen in FIG. 8, LED device 400 may include three LED circuits which are substantially pre-configured in circuit arrangements mirroring the circuit configurations formed during operation of LED device 300. LED device 400 includes bridge rectifier 402 having LED circuits 404, 406 and 408 connected in parallel relative thereto. LED circuit 404 includes at least one LED which may be a high amperage LED, though in FIG. 8 is shown as four parallel connected LEDs, and is connected to bridge rectifier 402 by at least one switch, shown in FIG. 8 as switches 410, 412. LED circuit 406 includes at least four LEDs arranged in a pair of series strings each having at least two LEDs and is connected to bridge rectifier by switch 412. LED circuit 408 includes at least one LED, which may be a high voltage LED, and is shown as a series string of four LEDs connected in series across the output of bridge rectifier 402.

In operation, controller 414 of device 400 will dynamically open and close switches 410, 412 as necessary to match the input voltage to the forward operating voltages of each LED circuit. For example, when an input 416 to controller 414 reaches a first value and/or threshold corresponding to voltage input reaching the lowest forward operating voltage of any of LED circuits 404, 406, 408, i.e. LED circuit 404, controller 414 will dynamically close switches 410, 412 causing LED circuit 404 to turn on.

As the input voltage continues to increase, and the input to controller 414 reaches a second value and/or threshold, in order to insure that the operative circuit within LED device 400 matches the increased input voltage, controller 414 will dynamically open switch 410 causing LED circuit 406 to begin emitting light.

As the input voltage continues to increase and eventually matches the forward operating voltage of LED circuit 408, the input to controller 414 will reach a third value and/or threshold and will dynamically open switch 412 forcing all current to flow through LED circuit 408. As the voltage begins to fall during the second half cycle, controller 414 will first close switch 412 when the input to the controller reaches a fourth value and/or falls back below the third threshold, and then may close switch 410 when the input to the controller reaches a fifth value and/or falls back below the second threshold.

As with LED device 300, where at least one capacitance circuit 200 is provided, for example as shown in FIG. 8, controller 414 may dynamically open and close switches to connect any of LED circuits 404, 406, 408 to the voltage input.

Figure 9A:
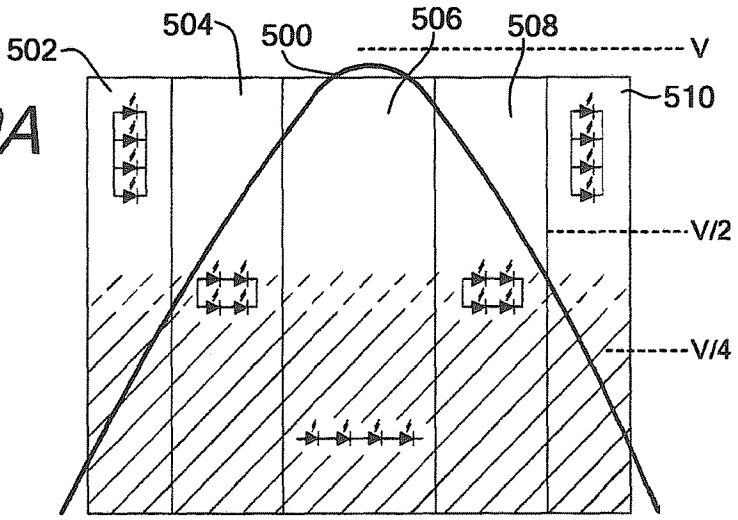
FIG. 9A shows the light flux output of the devices shown in FIGS. 7A and 8 relative to an input voltage without a capacitance circuit as contemplated by the invention.
Figure 9B:
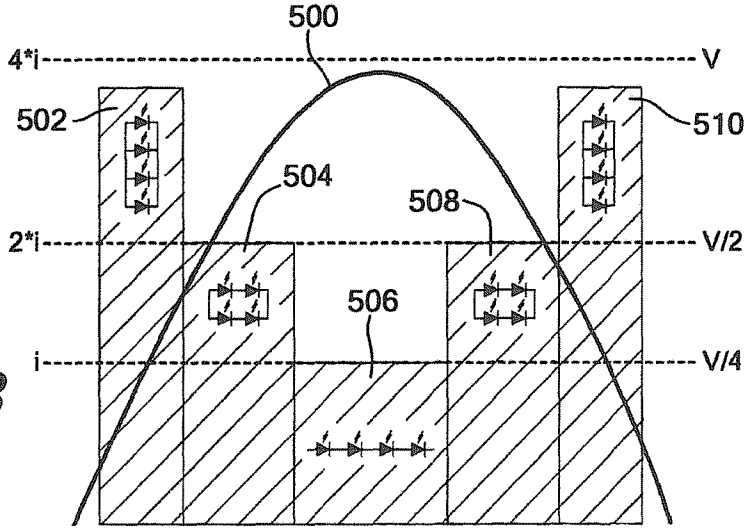
FIG. 9B shows the current drawn by the device shown in FIGS. 7A and 8 relative to an input voltage without a capacitance circuit as contemplated by the invention.

Without a capacitance circuit, the resulting light flux and current with respect to the voltage for LED devices 300 and 400 can be seen in FIGS. 9A and 9B, respectively.

As seen in FIG. 9A, as with device 100, the problem of constantly changing light flux levels associated with linear step drives is substantially solved by devices 300 and 400. As a result of the configurations and resulting substantially constant power dissipation realized by the configurations created in response to the input voltage in LED devices 300 and 400, the light flux remains substantially constant throughout the entire input voltage half cycle 500. Though such will be described with respect to device 300, it should be understood that the corresponding pre-configured circuits in device 400 will have substantially the same light flux and current draw as the configurations connected in device 300 during each portion of the half cycle.

For example during portions 502 and 510, when the input voltage is above the forward operating voltage of each individual LED circuit 304, 306, 308, 310, LED circuits 304, 306, 308, 310 are connected in parallel in device 300, for example, current will be at its maximum level (see FIG. 9B) and voltage at its minimum level. As the input voltage increases (or decreases) and reaches portions 504, 508 and LED device 300, for example, switches to a series parallel relationship, the current will be cut (see FIG. 9B) while the voltage drop increases, substantially maintaining the total power dissipation within all the LED circuits, and likewise maintaining the total light flux of LED circuits 304, 306, 308, 310. When the voltage is at its maximum, and the current is at its minimum (see FIG. 9B) during portion 506, the LED circuits in device 300 for example will be connected in series to match the input voltage and reduce the current to again maintain a substantially constant power dissipation.

As seen in FIG. 9B, however, like device 100, the current drawn by devices 300, 400 is substantially inverted from the input voltage, creating an undesirable power factor and poor total harmonic distortion.

As seen in FIGS. 7B and 8, capacitance circuit 200 may connect within devices 300 and 400 in substantially the same manner as LED device 100, and may operate in substantially the same manner to improve the power factor and total harmonic distortion of devices 300, 400. Though described with respect to LED device 300, it should be understood that capacitance device 200 will operate in substantially the same manner in LED device 400. The resulting flux output, current draw, and current delivery of the capacitance circuit or circuits can be seen in FIGS. 10A-C respectively.

Figures 10B, 10C:
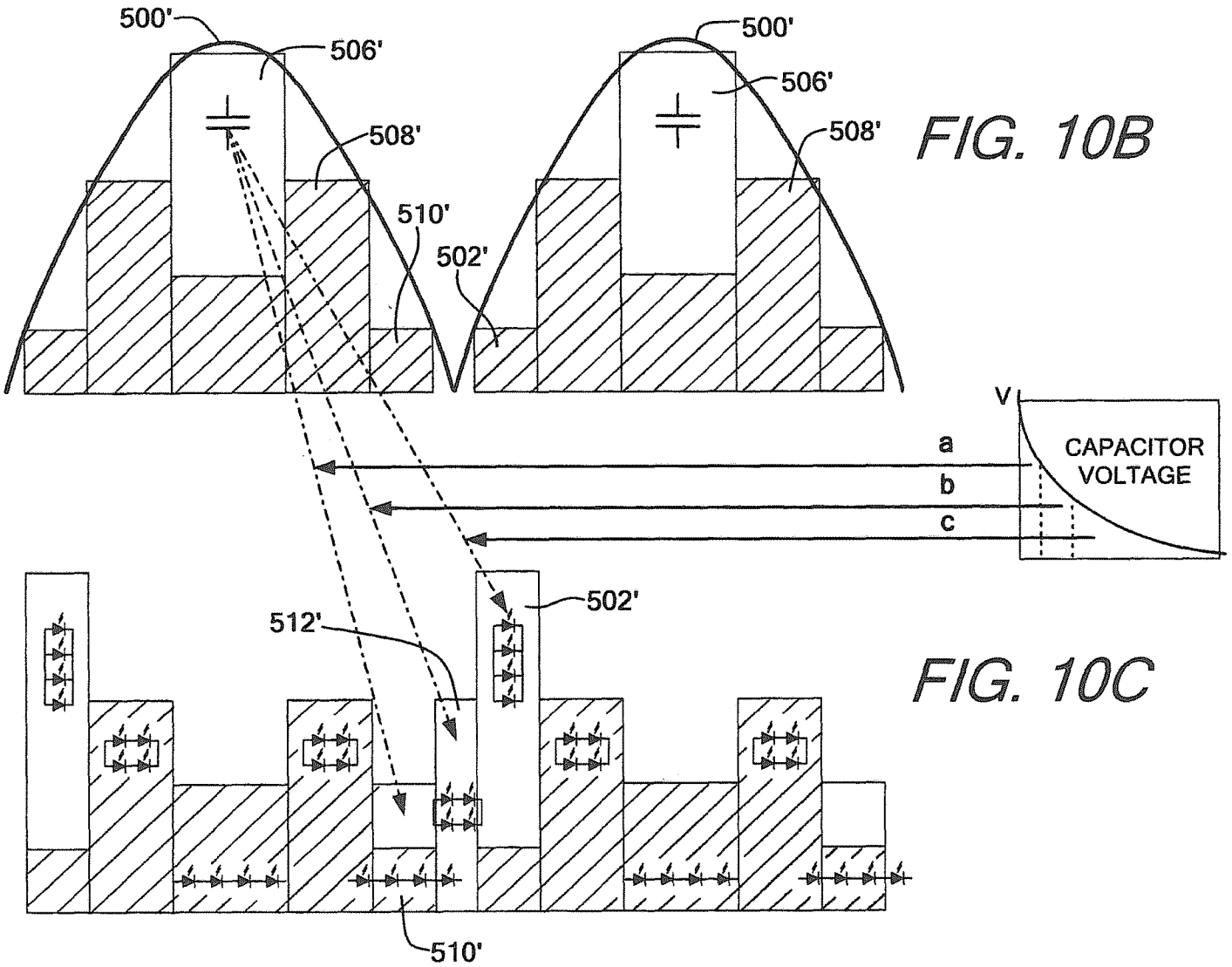
FIG. 10B shows the current drawn by the device shown in FIGS. 7B and 8 relative to an input voltage with at least one capacitance circuit as contemplated by the invention.
FIG. 10C shows the current provided by the capacitance circuit to the LED circuits in the devices shown in FIGS. 7B and 8.

For example, when a capacitance circuit 200 is connected in device 300 as shown in FIG. 7B, controller 324 will cause first capacitor switch 202 to dynamically close to place capacitance circuit 200 in series with bridge rectifier 302 to charge capacitor 206 when the input to the controller reaches the third value and/or third threshold (see input voltage 500' and portion 506' in FIG. 10B). As with device 100, closing first capacitance switch 202 and charging capacitor 202 at the third input value, when LED circuits 304, 306, 308, 310 are configured in the third configuration and drawing the smallest amount of current, will substantially improve the power factor and total harmonic distortion of device 300. Once the input the controller reaches a fourth value and/or drops below the third threshold (see portion 508' in FIG. 10B), controller 324 will open first switch 202 to disconnect capacitance circuit 200 from bridge rectifier 302. Because of the additional circuits and the second, series parallel, configuration, both switches will remain open until the input to controller 324 reaches the fifth value and/or drops below the second threshold. Closing the second switch while the input to the controller exists between the second and third thresholds is unnecessary as the added circuits and configuration can be configured to create a total current draw in line with an acceptable power factor.

Once the input to the controller reaches the fifth value and/or drops below the second threshold (see portion 510' in FIGS. 10B and 10C), controller 324 may dynamically connect LED circuits 304, 306, 308, 310 in any of the first, second or third configurations and close second capacitor switch 204 to connect capacitor 206 to the LED circuits. As described with respect to device 100, closing the switches at the final portion of the input voltage will allow at least one capacitor to supplement the input voltage and current to help achieve and maintain and acceptable power factor and an acceptable level of total harmonic distortion.

As the input to the controller reaches a sixth value and/or drops below the first threshold (see portion 512' in FIGS. 10A and 10C), controller 324 will keep second switch 202 closed to provide power to LED circuits 304, 306, 308, 310 until the input reaches the first value and/or first threshold again when the input voltage is high enough to match and exceed the forward operating voltage of at least one of LED circuits 304, 306, 308, 310.

Once the input to the controller reaches the first value and/or first threshold (see portion 502' in FIGS. 10B and 10C), controller 324 will keep second switch 204 closed so that capacitor 206 can continue to discharge and supplement the input to help maintain a satisfactory power factor and total harmonic distortion while maintaining a substantially constant level of light flux from the device.

In order to further improve the power factor and harmonic distortion, additional capacitance circuits may be added to the device, in parallel, with each capacitance circuit being substantially similar (as seen in FIGS. 3C and 7B, for example). In order to improve the power factor and distortion, both the first and second switches may be controlled independent of each other so that charging and discharging is staggered during a full input voltage cycle.

Figure 11:
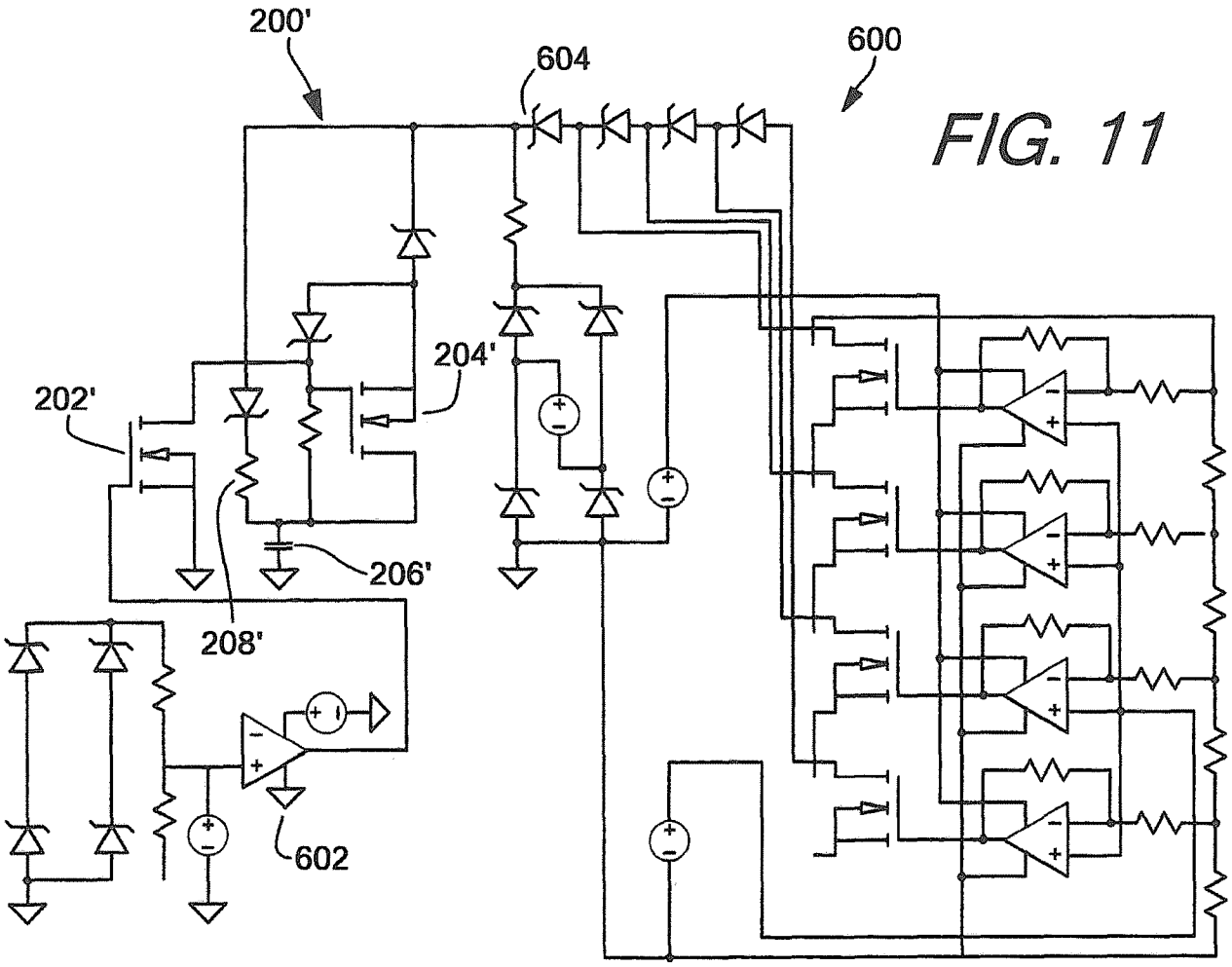
FIG. 11 shows a schematic diagram of an embodiment of the invention.

FIG. 11 shows a further embodiment of the invention which substantially reduces or eliminates flicker in prior art devices like that shown in FIG. 1, however does not address the near constant changing power dissipation within the device.

Device 600 in FIG. 11 operates in substantially the same manner as described above with respect to FIG. 1, but additionally includes a capacitance circuit 200' substantially similar to capacitance circuit 200. In order to control capacitance circuits 200' and 200", device 600 may include a controller 602 which will control first and second capacitance switches 202' and 204' of capacitance circuit 200', and will also control first and second capacitance switches 202" and 204" of capacitance circuit 200". As has been previously described, controller 602 may close switches 202' and 202" to charge capacitors 206' and 206". When the input voltage reaches a level below that required to drive first group of LEDs 604, controller 602 may close second switch 202' to begin providing power to at least first group of LEDs 604. Second switch 202" may be closed independently of switch 202' in order to insure that power is provided throughout the entire period needed before the input voltage again reaches a level which matches the forward operating voltage of first group of LEDs 604. Current control 208' may also be provided in capacitance circuit 200' and serve substantially the same function as the current control 208 in capacitance circuit 200.

While in the foregoing there has been set forth various embodiments of the invention, it is to be understood that the present invention may be embodied in other specific forms without departing from the spirit or central characteristics thereof. The present embodiments, therefore, are to be considered in all respects as illustrative and not restrictive, and the invention is not to be limited to the details given herein. While specific embodiments have been illustrated and described, numerous modifications come to mind without significantly departing from the characteristics of the invention and the scope of protection is only limited by the scope of the accompanying claims.

What is claimed is:

1. An LED lighting device comprising:

a first LED circuit having at least one LED, the first LED circuit having at least a first switch connected in series with the first LED circuit;

a second LED circuit having at least one LED, the second LED circuit having at least a second switch connected in series with the second LED circuit;

a third switch configured to connect the first LED circuit in series with the second LED circuit;

a controller for dynamically controlling the first switch, the second switch and the third switch to connect the first LED circuit and the second LED circuit in series or parallel configurations in response to an input to the controller; and a dimmer control, wherein the dimmer control regulates voltage and current provided to each LED circuit.

2. The LED lighting device of claim 1 further comprising a bridge rectifier, the bridge rectifier being electrically connected in series with the first LED circuit and the second LED circuit.

3. The LED lighting device of claim 2 further comprising at least one capacitance circuit for storing charge and providing charge to at least one of the first LED circuit and the second LED circuit, the at least one capacitance circuiting including a first capacitor switch connected to bridge rectifier and the controller;

a second capacitor switch connected to at least one of the first LED circuit and the second LED circuit, and the controller;

a capacitor connected to each of the first and second capacitor switches, wherein, the controller dynamically closes the first capacitor switch to charge the capacitor during at least a first portion the input to the controller and the controller dynamically closes the second capacitor switch to discharge the capacitor to at least one of the first LED circuit and the second LED circuit during at least a second portion of the input to the controller.

4. The LED lighting device of claim 3 further comprising a current controlling device connected in series with the capacitor.

5. The LED lighting device of claim 4 wherein the current controlling device is passive.

6. The LED lighting device of claim 4 wherein the current controlling device is active.

7. The LED lighting device of claim 3 further comprising at least a second capacitance circuit for storing charge and providing charge to at least one of the first LED circuit and the second LED circuit, the second capacitance circuiting including a third capacitor switch connected to bridge rectifier and the controller;

a fourth capacitor switch connected to at least one of the first LED circuit and the second LED circuit, and the controller;

a second capacitor connected to each of the third and fourth capacitor switches, wherein the controller dynamically closes the third switch to charge the second capacitor during at least the first portion the input to the controller and the controller dynamically the fourth capacitor switch closes to discharge the capacitor to at least one of the first LED circuit and the second LED circuit during at least a third portion of the input to the controller, wherein the controller controls the fourth capacitor switch independent of the second capacitor switch.

8. The LED lighting device of claim 1, wherein the first LED circuit has a fourth switch connected in series with the first LED circuit and arranged with the first switch so that one switch is connected in series with the input of the first LED circuit and one switch is connected in series with the output of the first LED circuit, and the second LED circuit has a fifth switch connected in series with the second LED circuit and arranged with the second switch so that one switch is connected in series with the input of the second LED circuit and one switch is connected in series with the output of the second LED circuit.

9. The LED lighting device of claim 8 further comprising:

a third LED circuit having at least one LED and sixth and seventh switches connected in series with the third LED circuit and arranged so one switch is connected in series with the input of the third LED circuit and one switch is connected in series with the output of the third LED circuit;

a fourth LED circuit having at least one LED and eighth and ninth switches connected in series with the fourth LED circuit and arranged so one switch is connected in series with the input of the fourth LED circuit and one switch is connected in series with the output of the fourth LED circuit;

a tenth switch connected to the output of the second LED circuit and the input of the third LED circuit;

an eleventh switch connected to the output of the third LED circuit and the input of the fourth LED circuit, wherein each switch is electrically connected to and controlled by the controller, wherein the controller controls the switches to connect each of the first, second, third, and forth LED circuits in parallel;

the first LED circuit in series with the second LED circuit forming a first series circuit, and the third LED circuit connected in series with the fourth LED circuit forming a second series circuit, wherein the controller connects the first series circuit in parallel with the second series circuit; and each of the first, second, third, and fourth LED circuits in series.

10. The LED lighting device of claim 9 wherein each of the first, second, third and fourth LED circuits include at least two LEDs connected in series.

11. The LED lighting device of claim 10 wherein at least one of the first, second, third and fourth LED circuits emit light of a different wavelength that the remaining circuits.

12. The LED lighting device of claim 1 wherein the dimmer control is dynamically controlled by the controller.

13. The LED lighting device of claim 12 wherein the controller controls the dimmer control to reduce the voltage and current provided to the LED circuits during at least one portion of the phase of an input AC voltage.

14. An LED lighting device comprising:

a bridge rectifier;

a first LED circuit having at least four LEDs connected in series;

a first switch connected in parallel with a first of the at least four LEDs;

a second switch connected in parallel with a second of the at least four LEDs;

a third switch connected in parallel with a third of the at least four LEDs;

a fourth switch connected in parallel with a fourth of the at least four LEDs;

a first capacitance circuit, the first capacitance circuit having:

a first capacitor switch connected to the bridge rectifier and a controller;

a second capacitor switch connected to at least one LED in the first LED circuit; and a first capacitor connected to each of the first and second capacitor switches; and a second capacitance circuit, the second capacitance circuit having a third capacitor switch connected to bridge rectifier and the controller;

a fourth capacitor switch connected to at least one of the first LED circuit, the second LED circuit and the third LED circuit and the controller; and a second capacitor connected to each of the third and fourth capacitor switches;

wherein the controller dynamically controls the first, second, third and fourth switches to connect the first, second, third and fourth LEDs to each other in series in response to an input to the controller; and wherein the controller dynamically closes the first capacitor switch to charge the first capacitor during at least a first portion the input to the controller and dynamically closes the second capacitor switch to discharge the first capacitor to at least one of the at least four LEDs during at least a second portion of the input to the controller; and wherein the controller dynamically closes the third capacitor switch to charge the second capacitor during at least the first portion of the input to the controller and dynamically closes the fourth capacitor switch to discharge the second capacitor to at least one of the at least four LEDs during at least a third portion of the input to the controller.

15. An LED lighting device comprising:

a bridge rectifier;

a first LED circuit having at least one LED, the first LED circuit being connected to the bridge rectifier using at least a first switch;

a second LED circuit having at least two series strings of LEDs, the series strings each having at least two LEDs connected in series, the second LED circuit being connected to the bridge rectifier using a second switch;

a third LED circuit having at least four LEDs connected in series, the third LED circuit being connected to the bridge rectifier;

a controller for dynamically controlling the switches to connect the alternately connect first LED circuit, the second LED circuit to the bridge rectifier in response to an input to the controller, wherein a substantially identical amount of power is consumed by the first LED circuit, the second LED circuit or the third LED circuit when each circuit is individually switched in and connected to the bridge rectifier and provided with any required forward operating voltage; and at least one capacitance circuit for storing charge and providing current to at least one of the first, second and third LED circuits, the at least one capacitance circuiting including:

a first capacitor switch connected to bridge rectifier and the controller;

a second capacitor switch connected to at least one of the first LED circuit, the second LED circuit and the third LED circuit, and the controller; and a capacitor connected to each of the first and second capacitor switches, wherein, the controller closes the first capacitor switch to charge the capacitor during at least a first portion the input to the controller and the second capacitor switch closes to discharge the capacitor to at least one of the first LED circuit, the second LED circuit, and the third LED circuit during at least a second portion of the input to the controller.

16. The LED lighting device of claim 15 wherein the first circuit has at least two LEDs connected in parallel.

17. The LED lighting device of claim 15 further comprising at least a second capacitance circuit for storing charge and providing current to at least one of the first LED circuit and the second LED circuit, the second capacitance circuiting including:

a third capacitor switch connected to bridge rectifier and the controller;

a fourth capacitor switch connected to at least one of the first LED circuit and the second LED circuit, and the controller; and a second capacitor connected to each of the third and fourth capacitor switches, wherein the controller dynamically closes the third switch to charge the second capacitor during at least the first portion the input voltage phase and the controller dynamically closes the fourth capacitor switch to discharge the second capacitor to at least one of the first LED circuit, the second LED circuit and the third LED circuit during at least a third portion of the input voltage phase, wherein the controller controls the fourth capacitor switch independent of the second capacitor switch.

18. The LED lighting device of claim 15 wherein the controller closes the second capacitor switch to at least one different circuit of the first LED circuit, the second LED circuit and the third LED circuit during at least a third portion of the input voltage phase.

19. The LED lighting device of claim 15 further comprising a current controlling device connected in series with the capacitor.

20. The LED lighting device of claim 19 wherein the current controlling device is passive.

21. The LED lighting device of claim 19 wherein the current controlling device is active.

22. A method of driving an LED lighting device, the method comprising the steps of:

switching on a first capacitance circuit to charge a first capacitor during a second portion of an input voltage;

switching off the first capacitance circuit to stop charging the first capacitor and switching on a second capacitance circuit to charge a second capacitor during a third portion of the input voltage;

switching off the second capacitance circuit to stop charging the second capacitor during a fourth portion of the input voltage.

23. A method of driving an LED circuit, the method comprising the steps of: rectifying an input AC voltage;

controlling at least a first and a second switch to connect a first LED circuit and a second LED circuit in parallel during a first portion and a third portion of the phase of the input AC voltage;

controlling at least a third switch to connect the first and second LED circuits in series during a second portion of the phase of the input AC voltage.

24. The method of claim 23 further comprising the steps of:

connecting a capacitor to a rectifier providing rectified voltage during a second portion of the phase of the AC input voltage;

charging the capacitor during the second portion of the phase of the AC input voltage;

disconnecting the capacitor from the rectifier and connecting the capacitor to at least one of the first and second LED circuits;

discharging the capacitor during the first phase, the third phase, and a fourth phase of the AC input voltage.

25. A method of driving an LED circuit, the method comprising the steps of:

rectifying an input AC voltage;

controlling at least a first switch to connect a first LED circuit having at least one LED during at least a first portion of a half cycle of the input AC voltage;

controlling at least a second switch to connect a second LED circuit having at least two series strings of LEDs connected in parallel, the series strings each having at least two LEDs connected in series during a second portion of the half cycle of the AC input voltage; and connecting at least a third LED circuit having at least four LEDs connected in series to the output of a rectifier providing the rectified voltage.

26. The method of claim 25 further comprising the steps of:

connecting a series connected capacitor and a switch to a rectifier in series;

charging the capacitor during a third portion of the half cycle of the AC input voltage;

disconnecting the capacitor from the rectifier and connecting the capacitor to at least one of the first and second LED circuits; and discharging the capacitor during at least the first portion, a fourth portion, and a fifth portion of the AC input voltage.

27. An LED lighting device comprising:

a bridge rectifier;

a capacitor;

a current controlling device connected in series with the capacitor;

at least four LED circuits connected in parallel, each LED circuit having at least one LED and being connected in series with two switches;

at least three cross-connecting switches, each cross-connecting switch connecting an output of one LED circuit to an input of an adjacent LED circuit; and a controller, the controller receiving an input and dynamically controlling each of the switches and cross-connecting switches to connect the at least four LED circuits to the bridge rectifier in a parallel, series-parallel or series relationship in response to the input received by the controller.

28. The LED lighting device of claim 27 further comprising at least a second capacitance circuit for storing voltage and providing voltage to at least one of the at least four LED circuits, the second capacitance circuiting including a third capacitor switch connected to bridge rectifier and the controller;

a fourth capacitor switch connected to at least one of the four LED circuits and the controller;

a second capacitor connected to each of the third and fourth capacitor switches, wherein the controller dynamically closes the third switch to charge the second capacitor during at least the first portion the input to the controller and the controller dynamically the fourth capacitor switch closes to discharge the capacitor to at least one of the at least four LED circuits during at least a third portion of the input to the controller, wherein the controller controls the fourth capacitor switch independent of the second capacitor switch.

29. The LED lighting device of claim 27 further comprising at least one capacitance circuit for storing voltage and providing voltage to at least one of the at least four LED circuits, the at least one capacitance circuiting including:

a first capacitor switch connected to bridge rectifier and the controller;

a second capacitor switch connected to at least one of the four LED circuits and the controller;

a capacitor connected to each of the first and second capacitor switches, wherein, the controller dynamically closes the first capacitor switch to charge the capacitor during at least a first portion of the input to the controller and the controller dynamically closes the second capacitor switch closes to discharge the capacitor to at least one of the at least four LED circuits during at least a second portion of the input to the controller.

30. The LED lighting device of claim 27 wherein the current controlling device is active.

31. The LED lighting device of claim 27 wherein the current controlling device is passive.

* * * * *